US006909402B2

(12) United States Patent
Vance

(10) Patent No.: US 6,909,402 B2
(45) Date of Patent: Jun. 21, 2005

(54) LOOPED MULTI-BRANCH PLANAR ANTENNAS HAVING MULTIPLE RESONANT FREQUENCY BANDS AND WIRELESS TERMINALS INCORPORATING THE SAME

(75) Inventor: Scott LaDell Vance, Cary, NC (US)

(73) Assignee: Sony Ericsson Mobile Communications AB, Lund (SE)

( * ) Notice: Subject to any disclaimer, the term of this patent is extended or adjusted under 35 U.S.C. 154(b) by 0 days.

(21) Appl. No.: 10/458,865

(22) Filed: Jun. 11, 2003

(65) Prior Publication Data

US 2004/0252061 A1 Dec. 16, 2004

(51) Int. Cl.[7] ..... H01Q 1/24

(52) U.S. Cl. ..... 343/702; 343/700 MS; 343/846

(58) Field of Search ..... 343/700, 702, 343/829, 846, 866, 741

(56) References Cited

U.S. PATENT DOCUMENTS

| | | | | |
|---|---|---|---|---|
| 5,434,579 A | | 7/1995 | Kagoshima et al. | 343/700 |
| 5,684,492 A | | 11/1997 | Kagoshima et al. | 343/700 |
| 5,926,139 A | | 7/1999 | Korisch | 343/702 |
| 6,195,048 B1 | | 2/2001 | Chiba et al. | 343/700 |
| 6,229,487 B1 | | 5/2001 | Sadler et al. | 343/700 |
| 6,346,914 B1 | * | 2/2002 | Annamaa | 343/700 MS |
| 6,366,243 B1 | * | 4/2002 | Isohatala et al. | 343/700 MS |
| 6,380,905 B1 | | 4/2002 | Annamaa et al. | 343/767 |
| 6,515,629 B1 | * | 2/2003 | Kuo et al. | 343/700 MS |
| 6,538,604 B1 | | 3/2003 | Isohatala et al. | 343/700 |
| 6,573,869 B2 | * | 6/2003 | Moore | 343/702 |
| 6,693,594 B2 | * | 2/2004 | Pankinaho et al. | 343/700 MS |

FOREIGN PATENT DOCUMENTS

| | | | |
|---|---|---|---|
| DE | 10054192 A | 5/2002 | H01Q/5/01 |
| EP | 0973230 A | 1/2000 | H01Q/13/08 |

OTHER PUBLICATIONS

Dou, Wei Ping et al., Novel Meandered Planar Inverted–F Antenna For Triple–Frequency Operation, Microwave and Optical Technology Letters, Oct. 5, 2000, pp. 58–60, vol. 27, No. 1, Singapore.

Ollikainen, Jani et al., Internal Dual–Band Patch Antenna for Mobile Phones, Helsinki University of Technology, Finland, date unknown, but for examination purposes, the date is before Dec. 17, 2002, p. 364 (4 sheets).

Wong, Kin–Lu, Chapter One, Introduction and Overview, Planar Antennas for Wireless Communications, Jan. 2003, pp. 1–25, ISBN: 0–471–26611–6.

PCT International Search Report, International Application No. PCT/IB2004/000085 filed Jan. 14, 2004; mailed Jun. 4, 2004.

PCT Written Opinion of the International Searching Authority, Jun. 4, 2004.

* cited by examiner

*Primary Examiner*—Tho Phan
(74) *Attorney, Agent, or Firm*—Myers Bigel Sibley & Sajovec PA

(57) ABSTRACT

Antennas and wireless terminals that incorporating the antennas include conductive elements that have a looped track element that can resonate at high and low bands to provide a multi-band PIFA.

77 Claims, 17 Drawing Sheets

HIGHBAND "B"

LOWBAND "A"

ANTENNA RADIATION PATTERN - 1850
(MEASURED AT 6 mm ANTENNA HEIGHT)

ANTENNA RADIATION PATTERN - 1990
(MEASURED AT 6 mm HEIGHT)

ANTENNA RADIATION PATTERN (3 mm HEIGHT)
1580 Mhz (GPS):

2.1 GHZ

ANTENNA RADIATION PATTERN:
(MEASURED AT 3 mm ANTENNA HEIGHT) 1850 MHz

ANTENNA RADIATION PATTERN
(MEASURED AT 3 mm ANTENNA HEIGHT) 1990 MHz

AT 3 mm antenna height: Following resonances:

1) 913 MHz (1/4 wave)
2) 1.8 GHz (1/2 wave)
3) 2.9 GHz
4) 3.45 GHz
5) 4.75 GHz
6) 5.95 GHz

ADDITIONAL HIGHER ORDER MODES ARE PRESUMABLY ALSO PRESENT

VSWR OF BASIC LOOPED DESIGN

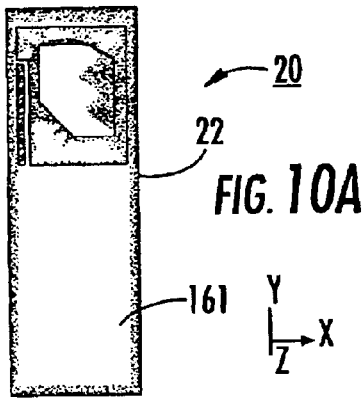
FIG. 10A
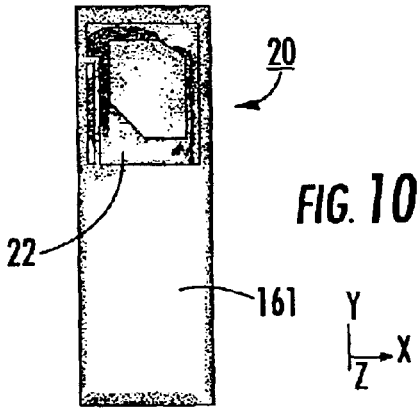
FIG. 10C
FIG. 10B
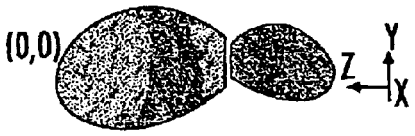
FIG. 10D
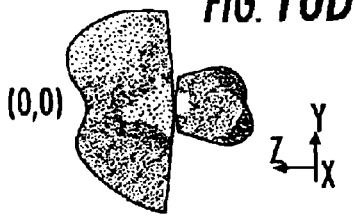
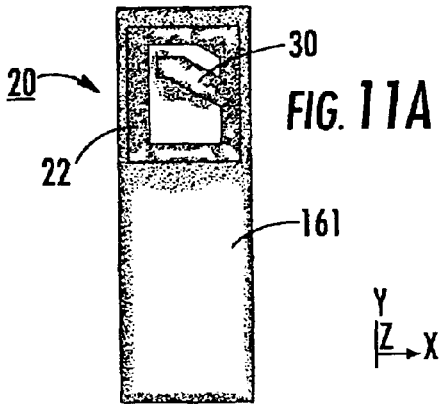
FIG. 11A
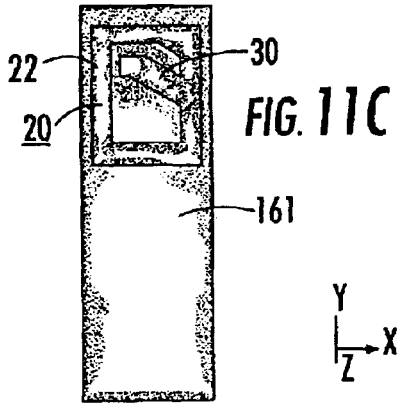
FIG. 11C
FIG. 11B
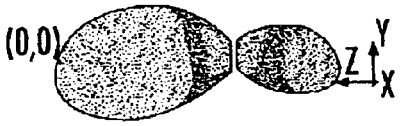
FIG. 11D
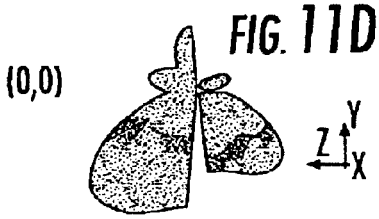

LOOPED MULTI-BRANCH PLANAR ANTENNAS HAVING MULTIPLE RESONANT FREQUENCY BANDS AND WIRELESS TERMINALS INCORPORATING THE SAME

FIELD OF THE INVENTION

The present invention relates to the field of communications, and, more particularly, to antennas and wireless terminals incorporating the same.

BACKGROUND OF THE INVENTION

The size of wireless terminals has been decreasing with many contemporary wireless terminals being less than 11 centimeters in length. Correspondingly, there is increasing interest in small antennas that can be utilized as internally mounted antennas for wireless terminals. Inverted-F antennas, for example, may be well suited for use within the confines of wireless terminals, particularly wireless terminals undergoing miniaturization. Typically, conventional inverted-F antennas include a conductive element that is maintained in a spaced apart relationship with a ground plane. Exemplary inverted-F antennas are described in U.S. Pat. Nos. 6,538,604 and 6,380,905, which are incorporated herein by reference in their entirety.

Furthermore, it may be desirable for a wireless terminal to operate within multiple frequency bands in order to utilize more than one communications system. For example, Global System for Mobile communication (GSM) is a digital mobile telephone system that typically operates at a low frequency band, such as between 880 MHz and 960 MHz. Digital Communications System (DCS) is a digital mobile telephone system that typically operates at high frequency bands, such as between 1710 MHz and 1880 MHz. In addition, global positioning systems (GPS) or Bluetooth systems use frequencies of 1.575 or 2.4–2.48 GHz. The frequency bands allocated for mobile terminals in North America include 824–894 MHz for Advanced Mobile Phone Service (AMPS) and 1850–1990 MHz for Personal Communication Services (PCS). Other frequency bands are used in other jurisdictions. Accordingly, internal antennas are being provided for operation within multiple frequency bands.

Conventionally, PIFA configurations have branched structures such as described in U.S. Pat. No. 5,926,139, and position the PIFA a relatively large distance, typically from about 7–10 mm, from the ground plane to radiate effectively. Kin-Lu Wong, in *Planar Antennas for Wireless Communications*, Ch. 1, p. 4, (Wiley, January 2003), illustrates some potential radiating top patches for dual-frequency PIFAS. The contents of each of these references are hereby incorporated by reference in their entirety herein. Despite the foregoing, there remains a need for alternative multi-band planar antennas.

SUMMARY OF THE INVENTION

Embodiments of the present invention provide antennas for communications devices and wireless terminals. The antennas include a looped conductive planar element that may be particularly suitable for a planar inverted-F antenna (PIFA) element.

In certain embodiments, planar inverted-F antennas are configured to operate at a plurality of resonant frequency bandwidths of operation (typically between about 2–4) and include: (a) a signal feed; (b) a ground feed; and (c) a looped conductive element in communication with the signal and ground feed.

In certain embodiments, the antennas can be positioned about 3 mm from the ground plane that may be provided by a printed circuit board (overlying or underlying the looped antenna element). The ground plane may also be looped in a size and configuration that substantially corresponds to the looped conductive element.

In some embodiments, the looped conductive element is configured with a center aperture that extends substantially the entire distance between the internal edge portions of the looped conductive element. The conductive element can have a substantially rectangular shaped perimeter, with each side being contiguous with the two adjacent sides, the perimeter with a width of about 37 mm and a height of about 46.5 mm.

In particular embodiments, the antenna is configured to operate at a first (low band) of between about 824–894 MHz and at least one second (high band) of between about 1850–1990 MHz.

Certain embodiments are directed to a planar inverted-F antenna having a plurality of resonant frequency bandwidths of operation. The PIFA includes: a signal feed; a ground feed; and a conductive element in communication with the signal and ground feed. The conductive element includes a looped track element that, in operation, provides a high band resonator and a low band resonator.

Other embodiments are directed toward wireless terminals. The wireless terminals include: (a) a housing configured to enclose a transceiver that transmits and receives wireless communications signals; (b) a ground plane disposed within the housing; (c) a planar inverted-F antenna disposed within the housing and electrically connected with the transceiver; (d) a signal feed electrically connected to a looped track element; and (e) a ground feed electrically connected to the looped track element proximate the signal feed. The antenna includes: a planar dielectric substrate and a planar conductive element disposed on the planar dielectric substrate. The conductive element includes a looped track conductive element having a length and width and a center portion encased by the looped track, the looped track being configured to define about a ¼ wave resonator at a low frequency band and about a ½ wave resonator at a high frequency band.

In certain embodiments, the looped track element comprises an endless perimeter with four sides, wherein the ground and signal feeds are positioned adjacent each other proximate a common side at an upper or lower edge portion of the common side of the looped track element.

Still other embodiments are directed to methods for exciting a planar inverted F antenna having low and high band operational modes. The method includes: (a) providing a conductive element with a looped track element, the looped track element configured to form about a ¼ wave resonator at a low frequency band and about a ½ wave resonator at a high frequency band; (b) generating a current null along at least one portion of the looped track at a selected low band operation; and (c) generating a current null at two spaced apart portions (typically substantially opposing sides) of the looped track at a selected high band operation.

These and other embodiments will be described further below.

BRIEF DESCRIPTION OF THE DRAWINGS

FIG. 10A is a top view of the antenna shown in FIG. 4A with a simulated excitation of the antenna at 1850 MHz operation according to embodiments of the present invention.

FIG. 10B is the simulated radiation pattern of the average current simulation shown in FIG. 10A.

FIG. 10C is a top view of the antenna shown in FIG. 4A with a simulated excitation of the antenna at 1990 MHz operation according to embodiments of the present invention.

FIG. 10D is the simulated radiation pattern of the average current simulation shown in FIG. 10C.

FIG. 11A is a top view of the antenna shown in FIG. 2A with a simulated excitation of the antenna at 1850 MHz operation according to embodiments of the present invention.

FIG. 11B is the simulated radiation pattern of the average current simulation shown in FIG. 11A.

FIG. 11C is a top view of the antenna shown in FIG. 2A with a simulated excitation of the antenna at 1990 MHz operation according to embodiments of the present invention.

FIG. 11D is the simulated radiation pattern of the average current simulation shown in FIG. 11C.

DETAILED DESCRIPTION OF EMBODIMENTS OF THE INVENTION

Figure 1A:
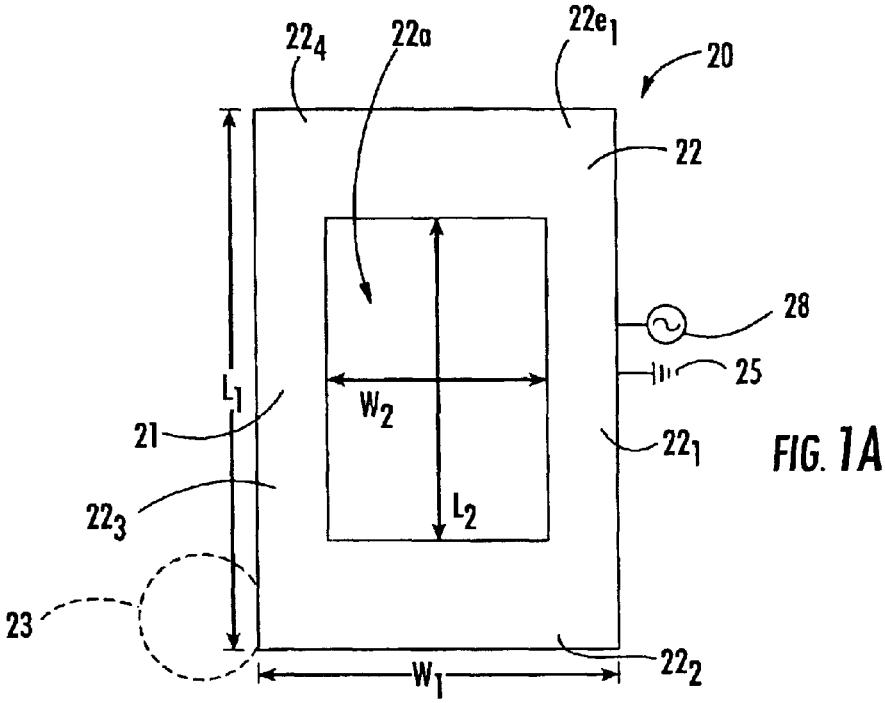
FIG. 1A is an enlarged schematic top view of a looped planar inverted-F antenna configuration according to embodiments of the present invention.

The present invention will now be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. It will be appreciated that although discussed with respect to a certain antenna embodiment, features or operation of one antenna embodiment can apply to others.

In the drawings, the thickness of lines, layers, features, components and/or regions may be exaggerated for clarity. It will be understood that when a feature, such as a layer, region or substrate, is referred to as being "on" another feature or element, it can be directly on the other element or intervening elements may also be present. In contrast, when an element is referred to as being "directly on" another feature or element, there are no intervening elements present. It will also be understood that, when a feature or element is referred to as being "connected" or "coupled" to another feature or element, it can be directly connected to the other element or intervening elements may be present. In contrast, when a feature or element is referred to as being "directly connected" or "directly coupled" to another element, there are no intervening elements present. The terms "looped" or "loop" track means a track or trace having a closed or substantially closed turn or an endless configuration.

Embodiments of the present invention will now be described in detail below with reference to the figures. The inverted-F conductive element can be configured to operate at a plurality, typically at least first and second, of resonant frequency bands and, in certain particular embodiments, can also be configured to operate at a third or more resonant frequency bands. Antennas according to embodiments of the present invention may be useful in, for example, multiple mode wireless terminals that support two or more different resonant frequency bands, such as world phones and/or dual mode phones. In certain embodiments, the antennas of the present invention can operate in a low frequency band and a high frequency band. The terms "low frequency band" or "low band" are used interchangeably and, in certain embodiments, include frequencies below about 1 GHz, and typically comprises at least one of 824–894 MHz or 880–960 MHz. The terms "high frequency band" and "high band" are used interchangeably and, in certain embodiments, include frequencies above 1 GHz, and typically frequencies between about 1.5–2.5 GHz. Frequencies in high band can include selected ones or ranges within about 1700–1990 MHz, 1990–2100 MHz, and/or 2.4–2.485 GHz.

In certain particular embodiments, the high frequency band may include frequencies that are less than twice that of the frequencies of the low frequency band. For example for a low band mode operating with frequencies between about 824–894 MHz, the high band mode can operate at frequencies below about 1.648–1.788 GHz.

In certain embodiments, the antenna may be configured to provide resonance for a global positioning system (GPS) as the terminal into which this antenna is to be built, can include a GPS receiver. GPS operates at approximately 1,575 MHz. GPS is well known to those skilled in the art. GPS is a space-based triangulation system using satellites and computers to measure positions anywhere on the earth. Compared to other land-based systems, GPS is less limited in its coverage, typically provides continuous twenty-four hour coverage regardless of weather conditions, and is highly accurate. In the current implementation, a constellation of twenty-four satellites that orbit the earth continually emit the GPS radio frequency. The additional resonance of the antenna as described above permits the antenna to be used to receive these GPS signals.

As used herein, the term "wireless terminal" may include, but is not limited to, a cellular wireless terminal with or without a multi-line display; a Personal Communications System (PCS) terminal that may combine a cellular wireless terminal with data processing, facsimile and data communications capabilities; a PDA that can include a wireless terminal, pager, internet/intranet access, web browser, organizer, calendar and/or a GPS receiver; and a conventional laptop and/or palmtop receiver or other appliance that includes a wireless terminal transceiver. Wireless terminals may also be referred to as "pervasive computing" devices and may be mobile terminals.

It will be understood by those having skill in the art of communications devices that an antenna is a device that may be used for transmitting and/or receiving electrical signals. During transmission, an antenna may accept energy from a transmission line and radiate this energy into space. During reception, an antenna may gather energy from an incident wave and provide this energy to a transmission line. The amount of power radiated from or received by an antenna is typically described in terms of gain.

Voltage Standing Wave Ratio (VSWR) relates to the impedance match of an antenna feed point with a feed line or transmission line of a communications device, such as a wireless terminal. To radiate radio frequency energy with minimum loss, or to pass along received RF energy to a wireless terminal receiver with minimum loss, the impedance of a wireless terminal antenna is conventionally matched to the impedance of a transmission line or feed point. Conventional wireless terminals typically employ an antenna that is electrically connected to a transceiver operatively associated with a signal processing circuit positioned on an internally disposed printed circuit board. In order to increase the power transfer between an antenna and a transceiver, the transceiver and the antenna may be interconnected such that their respective impedances are substantially "matched," i.e., electrically tuned to compensate for undesired antenna impedance components, to provide a 50-Ohm (Ω) (or desired) impedance value at the feed point.

Referring to FIG. 1A, the antenna 20 includes a conductive element 21 with at least one conductive looped track element 22 having four sides $\mathbf{22}_1$, $\mathbf{22}_2$, $\mathbf{22}_3$ and $\mathbf{22}_4$. As shown, edge portions of adjacent sides are contiguous. The looped track element 22 also has an associated center aperture 22*a*. The antenna 20 includes a signal feed 28 and ground feed 25. In certain embodiments, the ground 25 may be positioned on a common side portion of the element 21 below the signal feed 28 a distance of about 3–6 mm.

As shown, the center aperture 22*a* can be sized with a length and width, $L_2$, $W_2$, respectively, that separate the inner perimeter of the track a sufficient distance to inhibit parasitic coupling of opposing sides of the track. Examples of separation distances configured to limit coupling at conventional frequencies is at least about 3–4 mm. In certain particular embodiments, $L_2$ may be about 39 mm and $W_2$ may be about 29 mm with the element track 22 having a width ($W_1$–$W_2$ or $L_1$–$L_2$) between about 3–6 mm.

In certain embodiments, larger separation distances are used to that the high-band can be approximately twice the frequency of the low band. As the aperture 22*a* size or length $L_2$ and/or width $W_2$ decreases, the high-band frequency increases. With separations between the opposite sides of the tracks of less than 10 mm, it is possible to tune the antenna for a resonance of about 800–900 MHz in addition to frequencies of 2.2 GHZ or higher high band operation. However, for applications using about an 800–900 MHz resonance in addition to a 1.7–1.9 MHz resonance, larger separations of the primary parallel radiating branches (shown as left $\mathbf{22}_3$ and right $\mathbf{22}_1$ sides) may be desirable.

The aperture 22*a* can be an air space or filled with a non-conductive material (or a combination thereof). In operation, gain or tuning should not be degraded if a user positions fingers or hand over the non-conductive center region. In particular embodiments, the looped track element 22 is sized to provide an aperture 22*a* that can receive a display (such as a LCD) or other component therein. The length of the track $L_1$ may be on the order of about 47 mm and the width $W_1$ may be on the order of about 37 mm.

The looped antenna 20 configuration may be particularly suitable for clam-shell or flip type housing (wireless communication) designs. Claim-shell designs can have low profiles, larger image areas to accommodate a larger display on the flip and the user may place a digit in the center of the flip during operation. The looped antenna 20 can be used with these designs because it also has a relatively low (flat) profile, certain embodiments can be configured without center components (inhibiting user detuning during operation), and it uses a relatively large x, y area (length and width) relative to other PIFA or portable communication device antenna designs.

Figure 1B:
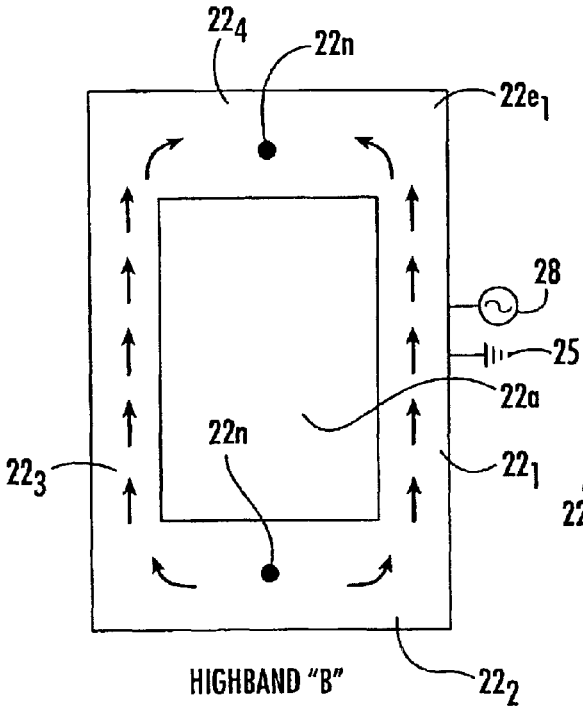
FIG. 1B is a schematic diagram of the antenna shown in FIG. 1A with an exemplary simulated high band radiation pattern with in-phase current as indicated by the current vectors.
Figure 1C:
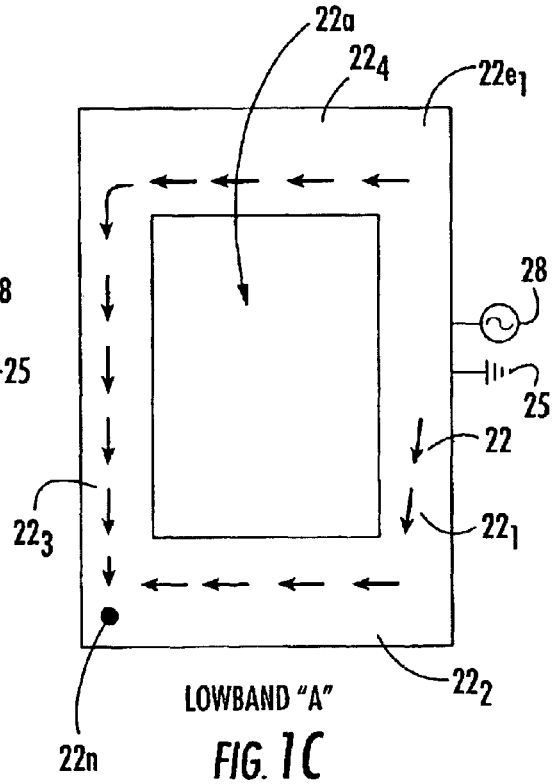
FIG. 1C is a schematic diagram of the antenna shown in FIG. 1A with an exemplary simulated low band ¼ wave resonance pattern with current direction indicated by the current vectors.

Generally described, in operation at low band (which can be described as band "A"), the conductive element 21 can act like a substantially solid conductive sheet with about a ¼ wave resonance. The resonant frequency in low band can be established by the selection of a suitable length ($L_1$) and width ($W_1$) of the looped track element 22 and/or adjusting the distance from the feed 28 to the upper edge portion 22$e_1$ of the looped track element 22. Increasing the area ($L_1$ and/or $W_1$) of the looped track element 22 can lower the resonant frequency while decreasing the area ($L_1$ and/or $W_1$) can raise the resonant frequency. The low band may also or alternatively be tuned by adjusting the distance from the feed and ground connections to the null corner 22*n* (FIG. 1C).

Figure 1D:
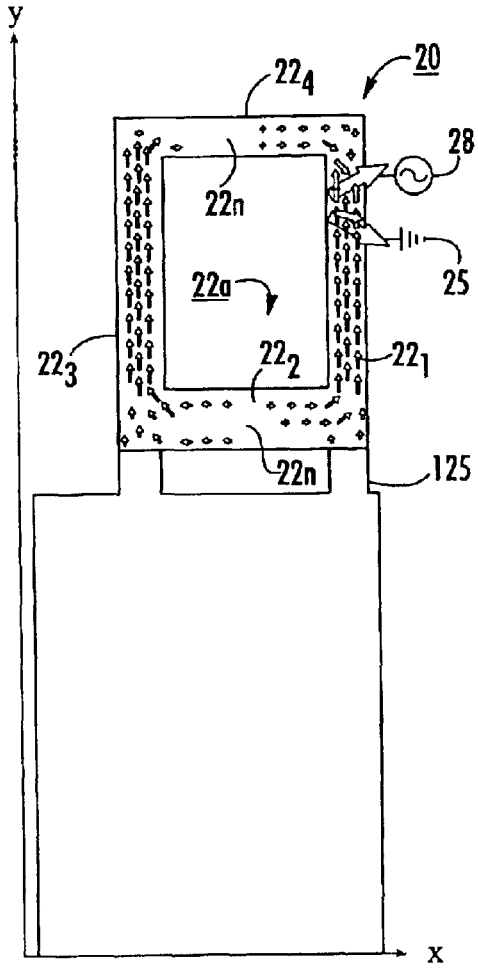
FIG. 1D is a top view of a looped antenna illustrating a high band current vector plot according to embodiments of the present invention.
Figure 1E:
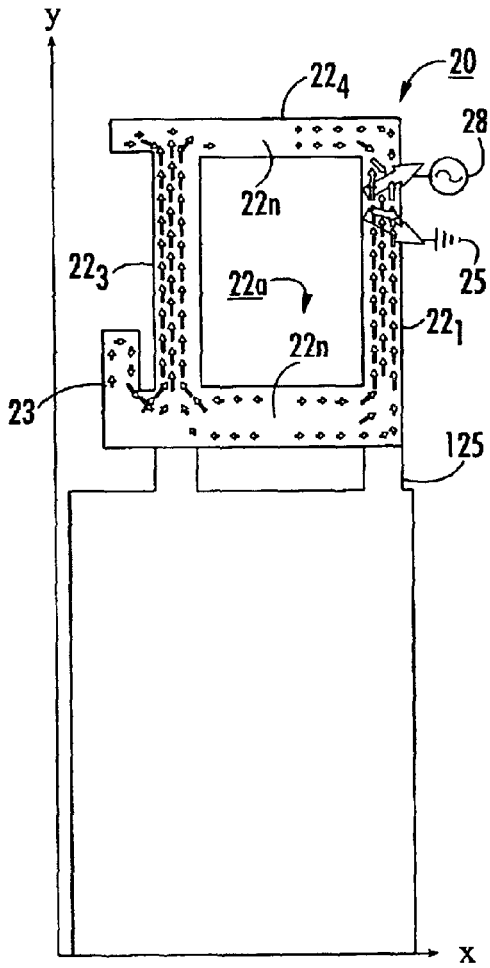
FIG. 1E is a top view of a looped antenna similar to that shown in FIG. 1D but with supplemental tuning features according to embodiments of the present invention.

At high band, the looped track element 22 can provide a primary high-band resonator (which can be described as "$B_1$"). In operation at high band, as shown in FIGS. 1B, 1D and 1E two distinct standing waves form on opposing sides or edges of the looped track 22, each at about a ½ wavelength resonance. Two non-adjacent sides (shown as the left and right sides 22$_3$, 22$_1$) of the looped track 22 can be at increased or maximum current while the opposing two sides of the looped track 22 are at a reduced or lower current (the low current sides are shown as top and bottom sides 22$_4$, 22$_2$). In this way, this configuration substantially functions as two parallel radiators with the horizontal components canceling and the radiation being generated substantially vertically and which may provide a cross-polarization that is about 10 db below the primary polarization. The main radiation peak is away from the looped track 22 and the back radiation can be relatively low. FIG. 1E also illustrates extra tuning branches 23 positioned on the left side 22$_3$ of the antenna 20 which may be particularly suitable for tuning 900/1800 bands used in Europe or other jurisdictions.

In certain embodiments, such as shown in FIGS. 1D and 1E, the ground plane 125 can have substantially the same shape as the element 22. This is not required but may allow the element 22 to be positioned closer to the ground plane 125. The configuration of the ground plane 125 away from the element 22 is shown as extending laterally a further distance, however this dimension and/or shape may be adjusted so that it aligns substantially with the element 22 (such as for the right side of the figure).

The high band resonance can be tuned or adjusted by altering the size of the inner perimeter (or spacing) of the looped track element 22 path (i.e., $L_2$ and/or $W_2$) and by adding tuning components such as the tuning branch 23 (shown as an optional feature by the broken line designation in FIG. 1A). In certain embodiments, the width ($W_2$) of the looped track and/or the width of the sides of the track 22 (particularly the left and right sides or the primary resonator sides) can be selected to tune the resonance at high band to a desired operational band. The external tuning branch 23 may be particularly suitable for tuning for when the second resonance band is less than about twice the frequency of the primary resonance band.

In certain embodiments, as will be discussed further below, the antenna 20 is configured to have between about 2–4 resonant bands with the low band including frequencies in the range of between about 824–894 MHz. The looped configuration (alone or with secondary branches as will be discussed below) can allow for multiple high-band resonances as well as a multi-band PIFA with good gain for high band at a distance of about 3 mm from the ground plane (typically defined by an underlying printed circuit board).

FIG. 1B illustrates a simulated high band radiation pattern with current vectors illustrated. As shown, the current is substantially in-phase in high band operation and there are two null corners 22*n* located at substantially diametrically opposing edge portions of the looped track 22 (where the horizontal sides merge into the vertical sides away from the ground and signal feeds 25, 28).

FIG. 1C illustrates a simulated low band radiation (such as at about 850 MHz) with a radiation pattern with current vectors illustrated. In this embodiment, a null corner 22*n* is disposed on a different edge portion of the looped track 22 than in the high band operation. As shown, the null corner 22*n* is located on the edge portion furthermost away from the signal and ground feed 28, 25, respectively.

Figure 2A:
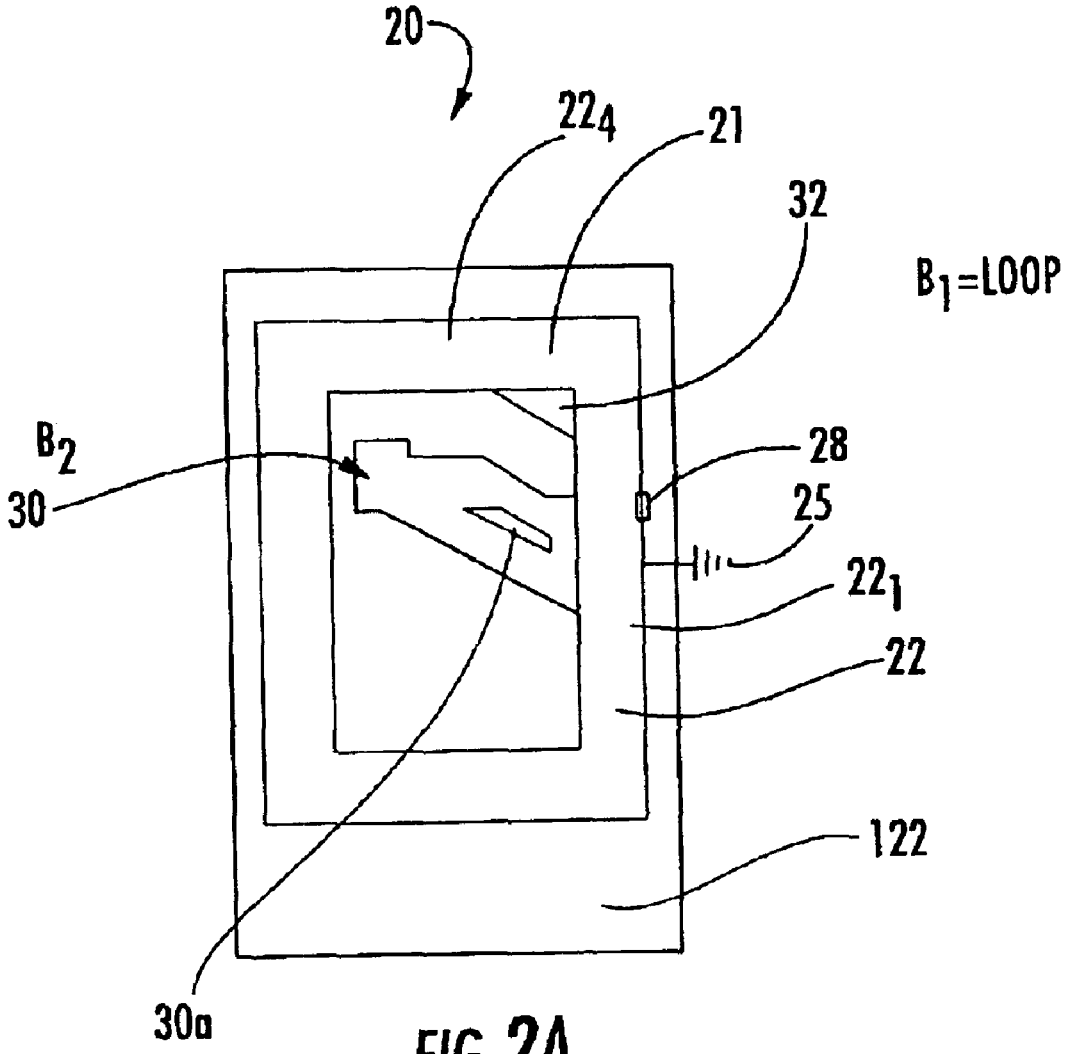
FIG. 2A is a top view of another looped planar inverted-F antenna according to embodiments of the present invention.

FIG. 2A illustrates that the antenna 20 may include a conductive element 21 that comprises the looped track 22 that provides a primary high band resonator "$B_1$" as well as a secondary branch 30 that provides a secondary resonator "$B_2$" (about a ¼ wave resonator) at high band. The secondary branch 30 may be configured with an aperture 30*a* that separates two substantially parallel strips as shown. The secondary branch 30 may be configured to angularly extend away from the side of the looped track 22 so as to inhibit destructive interference with the first high-band resonance $B_1$.

In addition, the secondary branch 30 may be positioned internal of the looped track 22 proximate the signal and ground 28, 25, as shown, or may alternatively be positioned to extend external of the looped track and outwardly away therefrom (not shown). The antenna conductive element 22 may comprise a corner member 32 between two adjacent sides 22 that can be used to tune the antenna 20. The gain of this antenna configuration can be a mixture of horizontal and vertically polarized components, which may be due in part to the angle at which the secondary branch 30 is oriented. The secondary branch 30 may be capacitively coupled to a portion of the looped track 22 such as a far corner portion thereof to have this resonance ($B_2$) be adjacent the other high-band resonance ($B_1$).

The secondary branch 30 is shown as the inner branch in this embodiment and, in operation, provides one resonance (in this embodiment the higher of the two high-band frequencies). The inner secondary branch 30 has polarization diversity and can provide a more omni-directional pattern. The outer loop 22 forms the lower high-band resonance and is vertically polarized with relatively low (typically about −10 db) cross polarization. Accordingly, the VSWR of the high band can be better than about 4:1 at about a 3 mm height which can be improved to about 2.5:1 at about a 6 mm height, across the high band (for example, across 1850–1990 MHz). Alternatively, the secondary high band resonance B2 can be separated for other frequency bands such as UMTS or Bluetooth (2.1 or 2.4 GHz). When used for higher frequencies, the bandwidth may be wider.

Figure 2B:
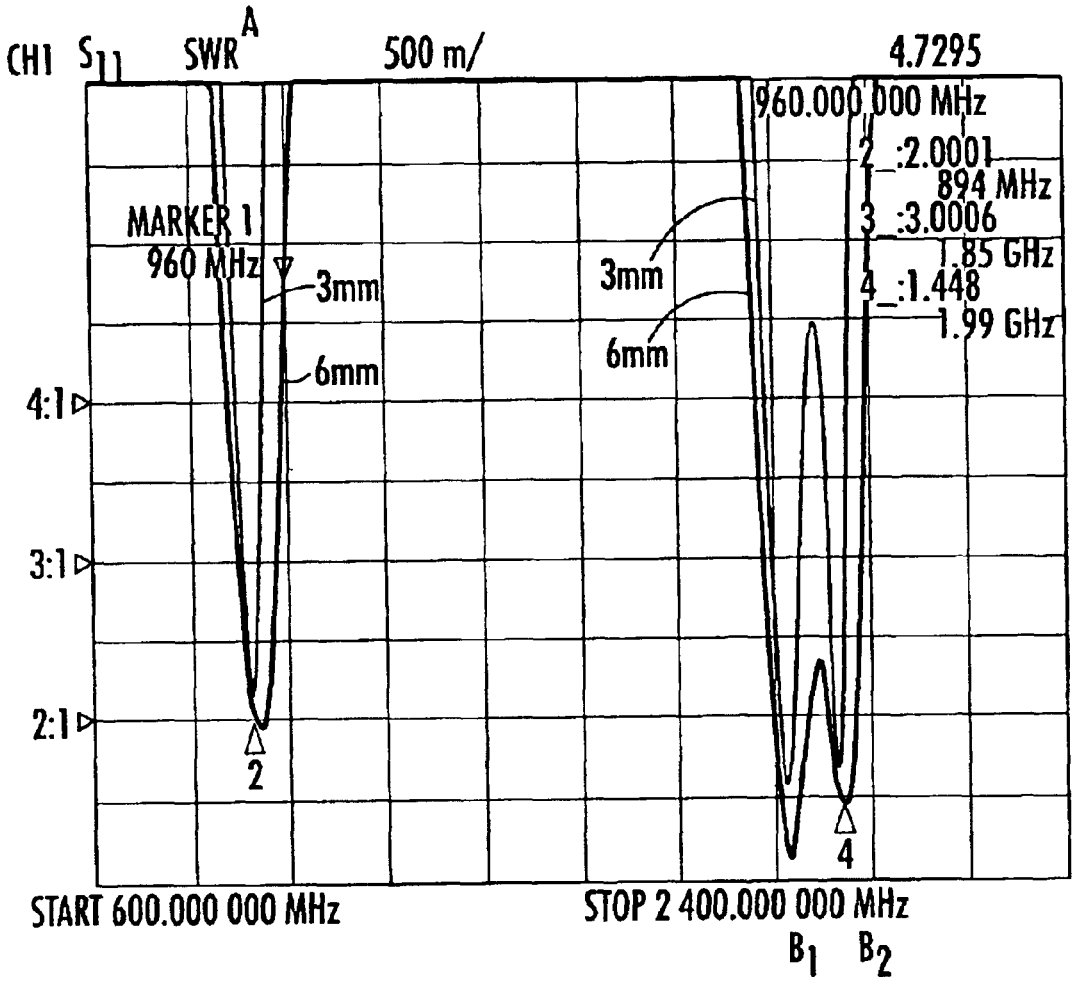
FIG. 2B is a VSWR graph at 3 mm and 6 mm height (from a ground plane) of the antenna shown in FIG. 2A. The 6 mm (higher) element is shown with a heavier line weight.

The length ($L_1$) of the looped track 22 can be about 46.5 mm; the width can be about 37 mm. The height or separation distance from the ground plane may be about 5 mm or less, and typically about 3 mm, although performance may be improved by increasing this distance (particularly low band performance). The ground pin may be positioned about 5 mm vertically below the feed. In the configuration shown in FIG. 2A, the antenna operates at low and high bands of about 824–894 MHz and 1850–1900 MHz, respectively. FIG. 2B is a representative VSWR graph illustrating low band resonance "A," primary high band resonance $B_1$ (from the looped track 22) and secondary high band resonance $B_2$ (from branch 30) corresponding to the antenna 20 shown in FIG. 2A (at 3 mm and 6 mm heights). At the 3 mm height, VSWR at band edges is about 8:1 for low and 3–4:1 for high band. At 6 mm height, VSWR is closer to 4:1 for low band a 2.5:1 for high band. In the figures where lower and higher element positions are drawn on the same plot, the outermost lines correspond to the higher placed elements 22.

Figure 2C:
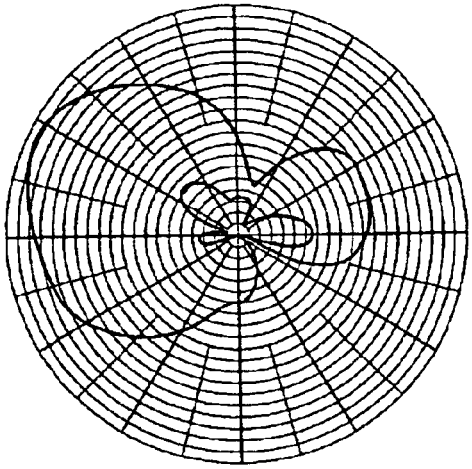
FIG. 2C is a polar coordinate graph of a front elevation radiation pattern at 1850 MHz of the antenna shown in FIG. 2A measured at about a 6 mm antenna height.
Figure 2D:
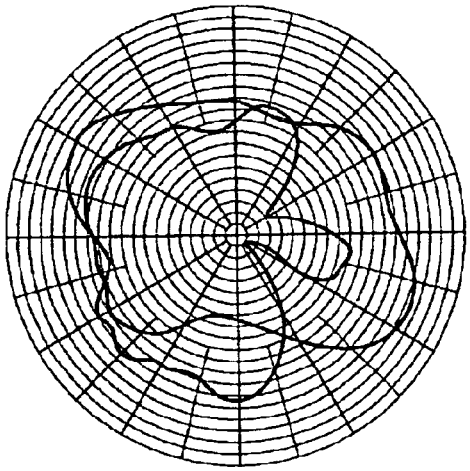
FIG. 2D is a polar coordinate graph of a front elevation radiation pattern at 1990 MHz of the antenna shown in FIG. 2A measured at about a 6 mm antenna height.

FIGS. 2C and 2D illustrate an exemplary antenna radiation pattern at about a 6 mm antenna height at 1850 MHz (FIG. 2C) and 1900 MHz (FIG. 2D) associated with the antenna configuration shown in FIG. 2A.

Figure 3A:
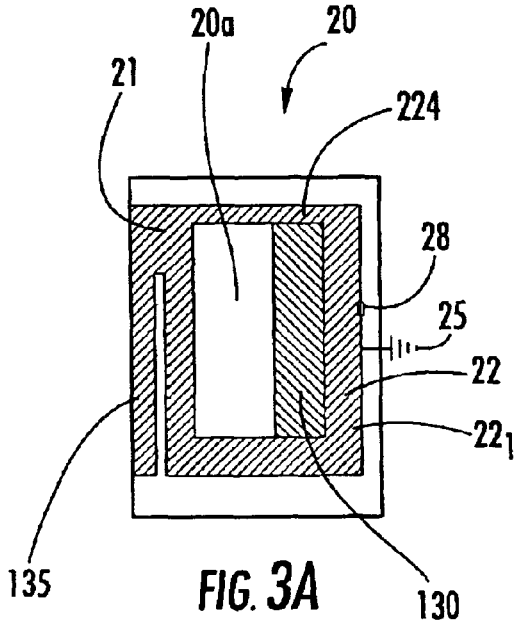
FIG. 3A is a top view of a planar inverted-F antenna according to additional embodiments of the present invention.

FIG. 3A is another embodiment of an antenna 20 with a looped track 22. In this embodiment, the antenna 20 is configured to generate three resonance bands, a low band "A" at between about 824–894 MHz, and two high bands $B_1$, $B_2$. The high bands can be tuned so that one is at 1575 MHz and one at 2.1–2.4 GHz (the higher band being $B_1$ and primarily attributed to the looped track 22). The antenna 20 includes a secondary band branch 135 (which creates band $B_2$ at the GPS resonance (1575 MHz) and can widen the high-band resonance). The high band range can be broadened by thickening (increasing the area or the width of the conductive trace) maximal current regions of the radiating element 22. The secondary branch 135 can be formed by slotting or splitting the left side (leg $\mathbf{22}_3$) of the looped element 22 and can provide additional bandwidth, as well as an additional resonant frequency. The additional resonant frequency can be tuned by adjusting the length of the slot used to create the secondary branch 135. As shown, the first side $\mathbf{22}_1$ has an extra-strip or width of track 130 that, in operation, can form part of the high band and low band resonators. In certain embodiments, the extra thickness may provide increased bandwidth in high band operation.

Figure 3B:
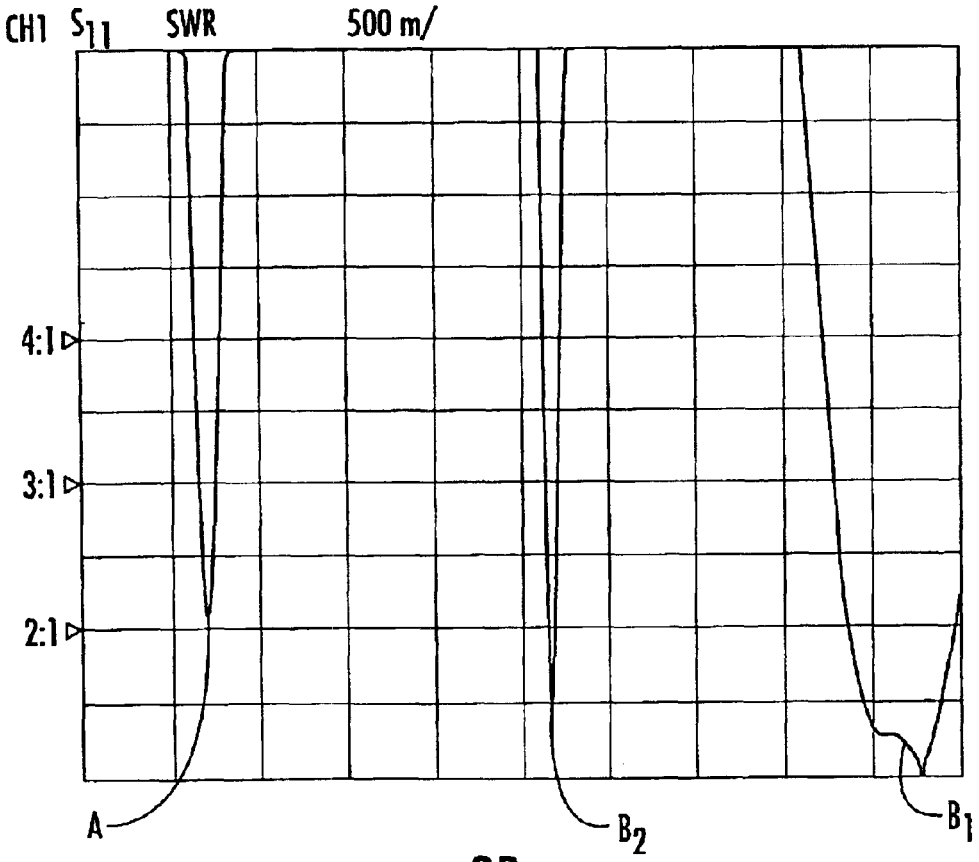
FIG. 3B is a VSWR graph of the antenna shown in FIG. 3A positioned at about 3 mm from the ground plane.

The antenna conductive element 22 can include a slit 135 along the vertical side $\mathbf{22}_3$ positioned across from the signal 28. The upper side $\mathbf{22}_4$ may be narrower across than the other sides. The high-band can be tuned to higher frequencies as desired. FIG. 3B illustrates a VSWR graph of the embodiment shown in FIG. 3A at about a 3 mm height. In this embodiment, the high band $B_1$ is relatively wide and can cover about 15% bandwidth (2150–2485 MHz) at VSWR of about 3:1. The length $L_1$ and width $W_1$ of the track 22 may be about 46.5 mm and 39 mm, respectively.

Figure 3C:
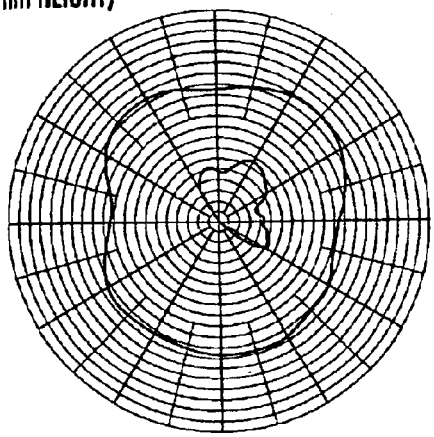
FIG. 3C is a polar coordinate graph of a front elevation radiation pattern at 1580 MHz (GPS) of the antenna shown in FIG. 3A measured at about a 3 mm antenna height.
Figure 3D:
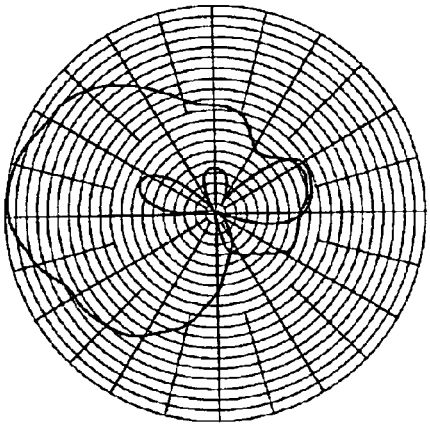
FIGS. 3D–3F are polar coordinate graphs of a front elevation, side elevation, and azimuth directions, respectively, of the radiation pattern at 2.1 GHz of the antenna shown in FIG. 3A measured at about a 3 mm antenna height.
Figure 3E:
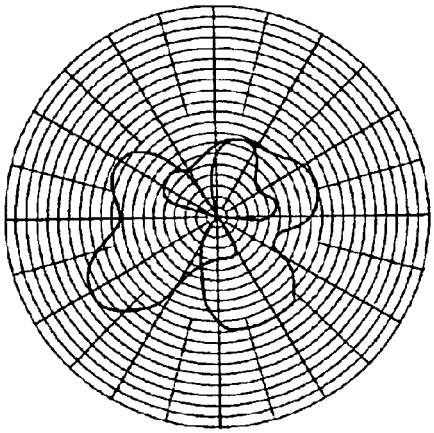
Figure 3F:
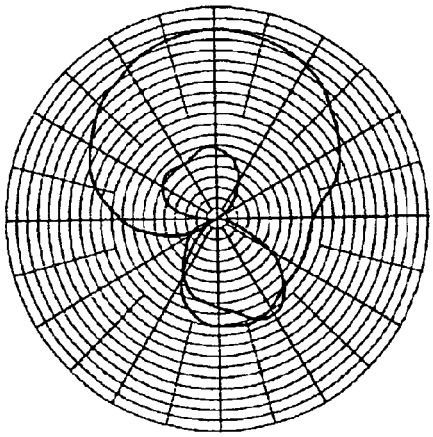

FIG. 3C illustrates an exemplary radiation pattern that may be provided by the antenna 20 shown in FIG. 3A at about 1580 MHz (generally corresponding to GPS). Peak values for front, side and azimuth directions are along −1.23, −2.3, and −0.85 dbi, respectively. FIGS. 3D–3F illustrate exemplary radiation patterns that may be provided by the antenna 20 shown in FIG. 3A at about 2.1 GHz (2.4 GHz patterns were similar). The pattern shown is directional with high vertical gain, particularly at Azimuth. The peak gain values are between about 3 and 4 dbi.

Figure 4A:
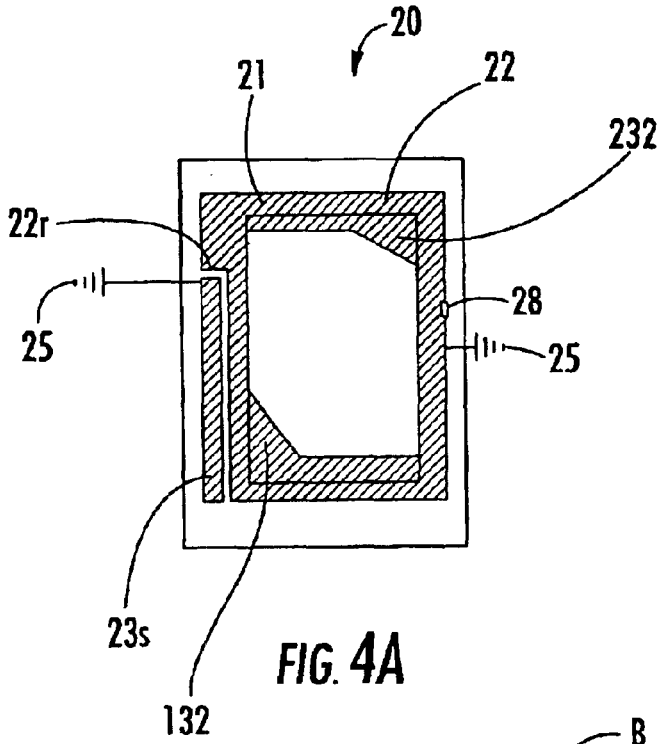
FIG. 4A is a top view of a planar inverted-F antenna according to yet other embodiments of the present invention.

FIG. 4A illustrates yet another embodiment of the antenna 20 having a conductive element 21 with a looped track 22. The length $L_1$ and width $W_1$ of the looped track element 22 may be about 45 mm and 38 mm, respectively. The ground 25 for the main looped element 22 may be located at about 3 mm below the signal feed 28. The conductive element 21 can include a secondary branch 235 that is a side parasitic element 235. The parasitic element 235 can be positioned proximate but spaced apart from (devoid of direct contact with) the looped track 22.

The parasitic element branch 235 can be disposed on the left and outside the left most side $\mathbf{22}_3$ of the track 22 and can be grounded 25 at its top outer edge portion as shown. Because this edge portion can be in a high current zone, the branch 235 can be excited and a resonance generated. Unlike the primary high band resonance, this resonance can radiate predominantly about the edge of the printed circuit board, which may provide an increased omni-directional pattern and multiple polarizations. The parasitic element 235 may be a vertical strip with a length that is greater than a major portion of the length of one of the longer sides $\mathbf{22}_3$ of the track 22. The length of the parasitic element can be sized to substantially correspond (approximately) to the electrical wavelength of the resonance (i.e., ¼ wavelength of the resonance frequency). The left side $\mathbf{22}_3$ may have a cut out receiving region 22*r* that is sized to receive the parasitic element 235 therein with the left side 223 being narrower alongside the portion adjacent the parasitic element 235. The antenna conductive element 21 may include tuning corner members 132 and 232.

Figure 4B:
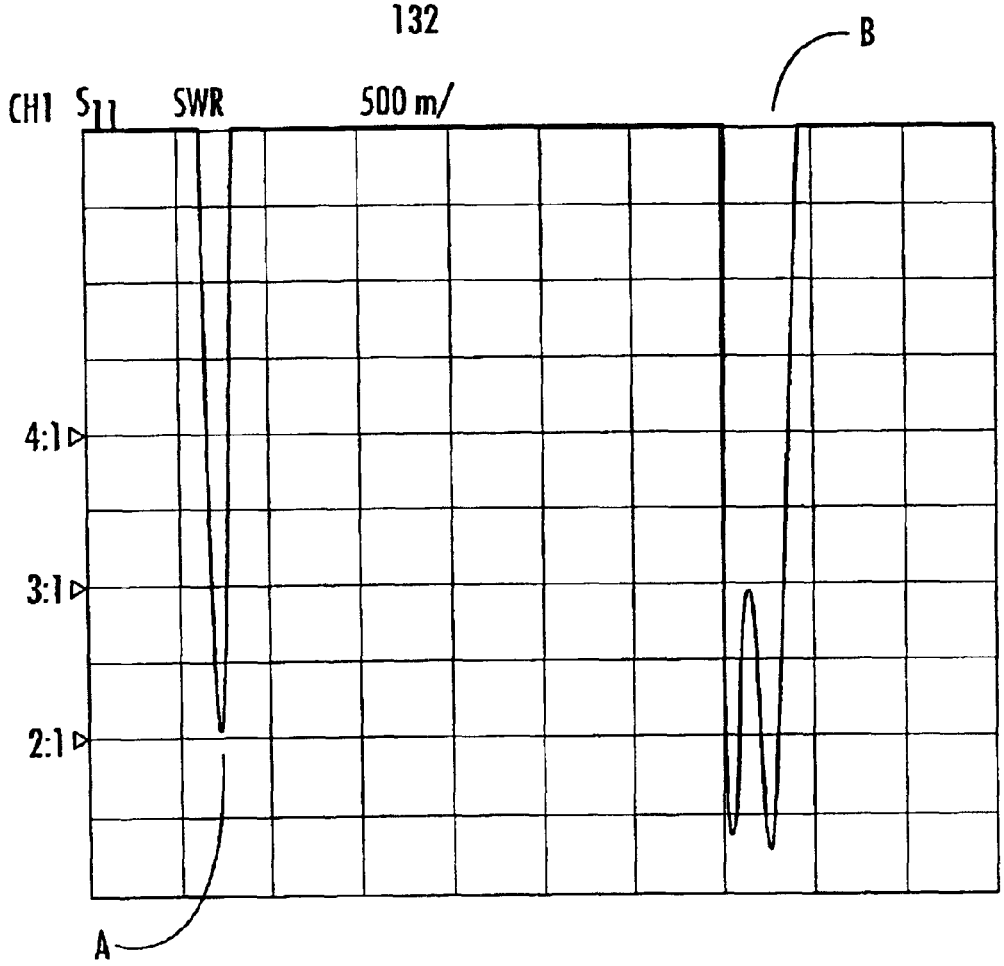
FIG. 4B is a VSWR graph of the antenna shown in FIG. 4A positioned at about a 3 mm height from the ground plane.

The parasitic element 235 can be the dominant radiator at the high end of the high band (typically about 1930–1990 MHz). The antenna 20 radiates at low band at between about 824–894 MHz. The high band B may operate between about 1.85–1.99 MHz. FIG. 4B illustrates an exemplary VSWR graph for the embodiment shown in FIG. 4A at a 3 mm height from the ground plane.

Figure 4C:
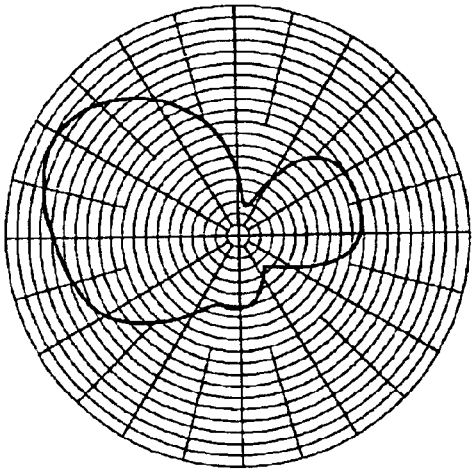
FIG. 4C is a polar coordinate graph of a front elevation radiation pattern at 1850 MHz of the antenna shown in FIG. 4A measured at about a 3 mm antenna height.
Figure 4D:
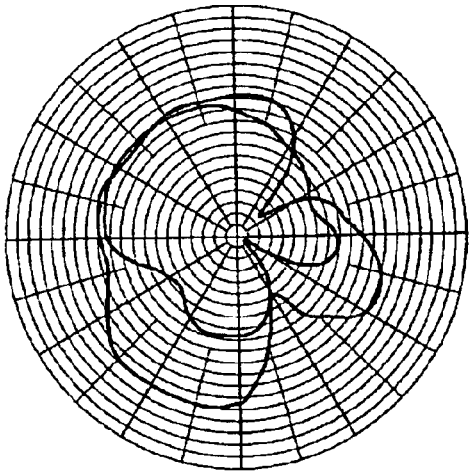
FIG. 4D is a polar coordinate graph of a front elevation radiation pattern at 1990 MHz of the antenna shown in FIG. 4A measured at about a 3 mm antenna height.

FIG. 4C illustrates an exemplary radiation pattern for the antenna 20 shown in FIG. 4A at 1850 MHz measured at about a 3 mm height. FIG. 4D illustrates an exemplary radiation pattern for the antenna shown in FIG. 4A at 1990 MHz measured at about a 3 mm height.

The embodiments shown in FIG. 2A and FIG. 4A may provide omni-directional gain at the higher end of the band. Thus, in receive mode, the communications device may be inhibited from dropping a call or signal based on the user's position (i e., which direction the user is facing).

Figure 5A:
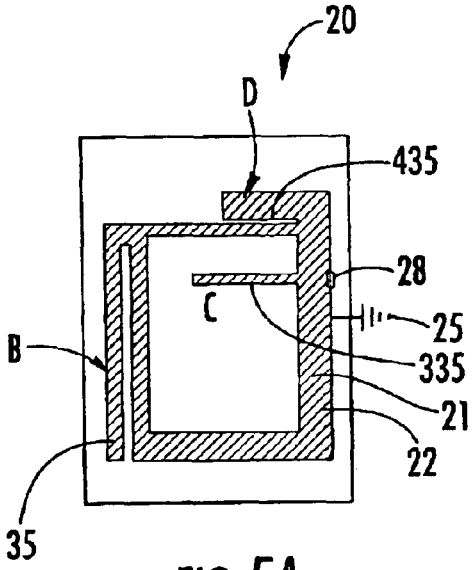
FIG. 5A is a top view of a planar inverted-F antenna according to still further embodiments of the present invention.
Figure 5B:
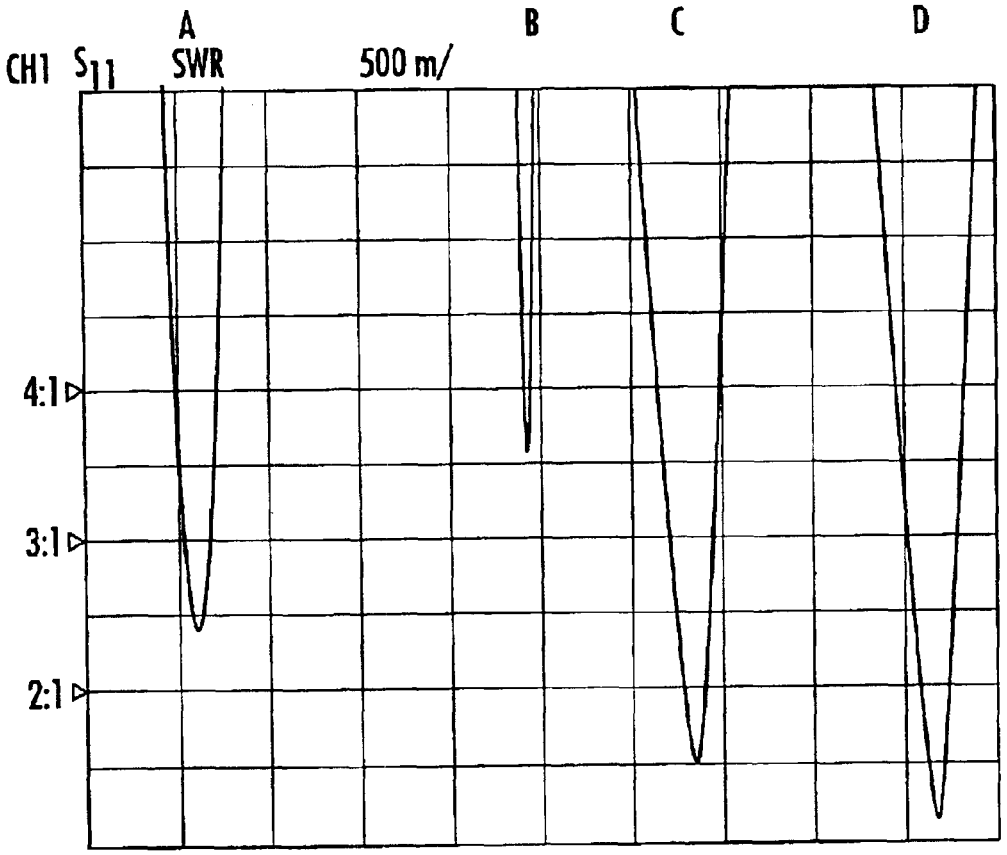
FIG. 5B is a VSWR graph of four different resonant bands provided by the antenna shown in FIG. 5A.

FIG. 5A illustrates yet another antenna 20 having a looped track 22. This embodiment is a quad-band antenna. It operates at low band "A" and high bands B, C and D (FIG. 5B). As before, a secondary branch 135 can be positioned along the outer side of one of the legs of the looped track 22 (typically the side opposite the side holding the signal and ground) and run a major portion of the length $L_1$ (typically at least about 75% of the length, and more typically substantially the entire length $L_1$). This secondary branch 135 can generate resonance B (typically about 1575 MHz for GPS). The looped track 22 can provide radiation at 1850–1990 (typically primarily from the left and right sides). As shown, the conductive element 21 also includes a third resonance branch 335 and a fourth resonance branch 435. The third resonance branch 335 can contribute to resonance C (typically about 1850–1890 MHz) and/or generate resonance D. The fourth branch 435 can generate or contribute to resonance D (typically about 2400–2485 for Bluetooth). As before the ground 25 can be placed below the signal feed 28 between about 3–6 mm, and typically between about 4–6 mm.

The fourth branch 435 can be the top branch and can be configured to primarily control tuning for high band C (such as 1850–1990 MHz) and/or the third (center) branch 335 can be configured to tune for band D (Bluetooth). The configuration of the secondary branch 135 (shown as the left branch) can be used to tune GPS (1575 MHz). As before, the length and width of the looped track ($L_1$, $W_1$, FIG. 1) and/or the width of the element sides can be used to tune or define the low band resonance.

Figure 6A:
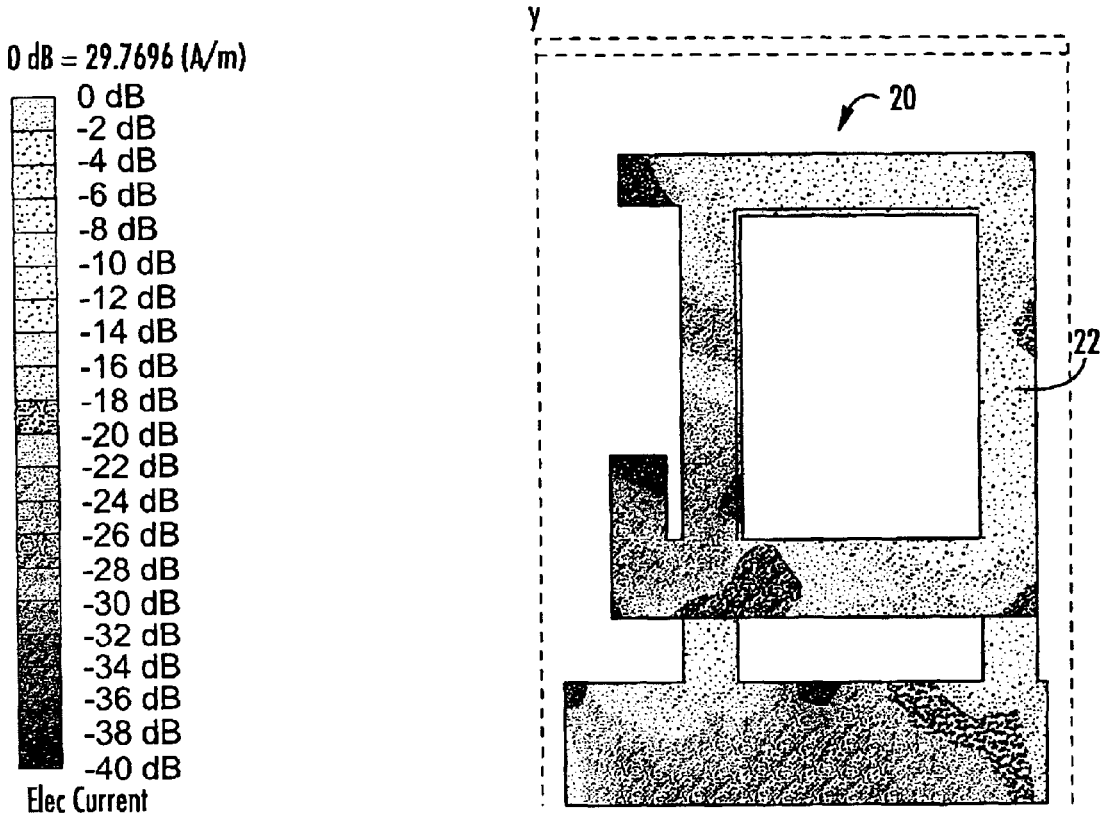
FIG. 6A is a looped antenna configuration with a gray scale pattern of current density at 0.95 GHz with a scale ranging from 0 db to −40 db of electric current (with 0 db=29.796 A/m).
Figure 6B:
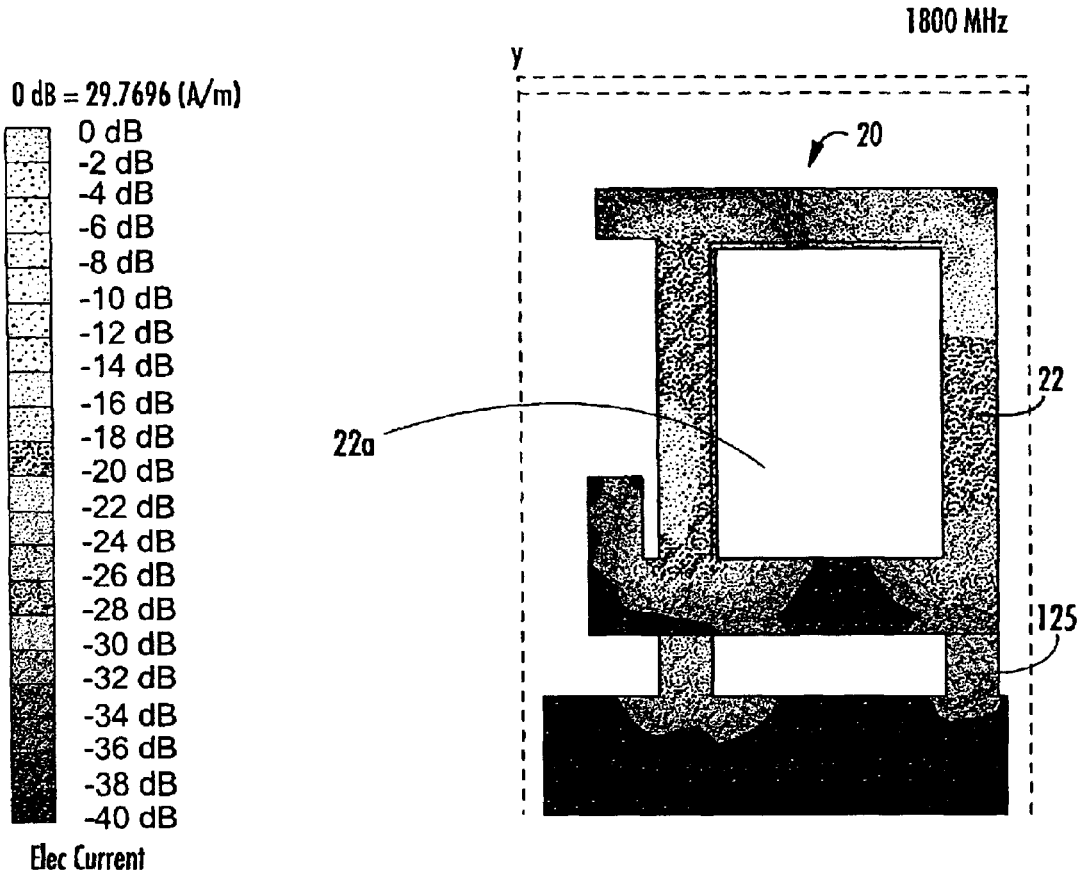
FIG. 6B is the looped antenna configuration shown in FIG. 6A with a gray scale pattern of current density at 2.4 GHz with a scale ranging from 0 db to −40 db of electric current (with 0 db=29.796 A/m).

FIG. 6A illustrates simulated electric current for the antenna 20 (with looped track 22) and underlying looped ground 125 with sides configured to substantially correspond to the sides of the element track 22 shown at 0.95 GHz with the adjacent gray scale chart illustrating current density A/m from 0 (29.7696 A/m) to −40 db. FIG. 6B illustrates the same antenna 20 with the electric current simulated at 1800 MHz. In certain embodiments, the looped ground plane 125 may have sides that are wider or longer but a center aperture that substantially corresponds to the center aperture 22*a* of the looped track 22 (not shown).

Figure 7:
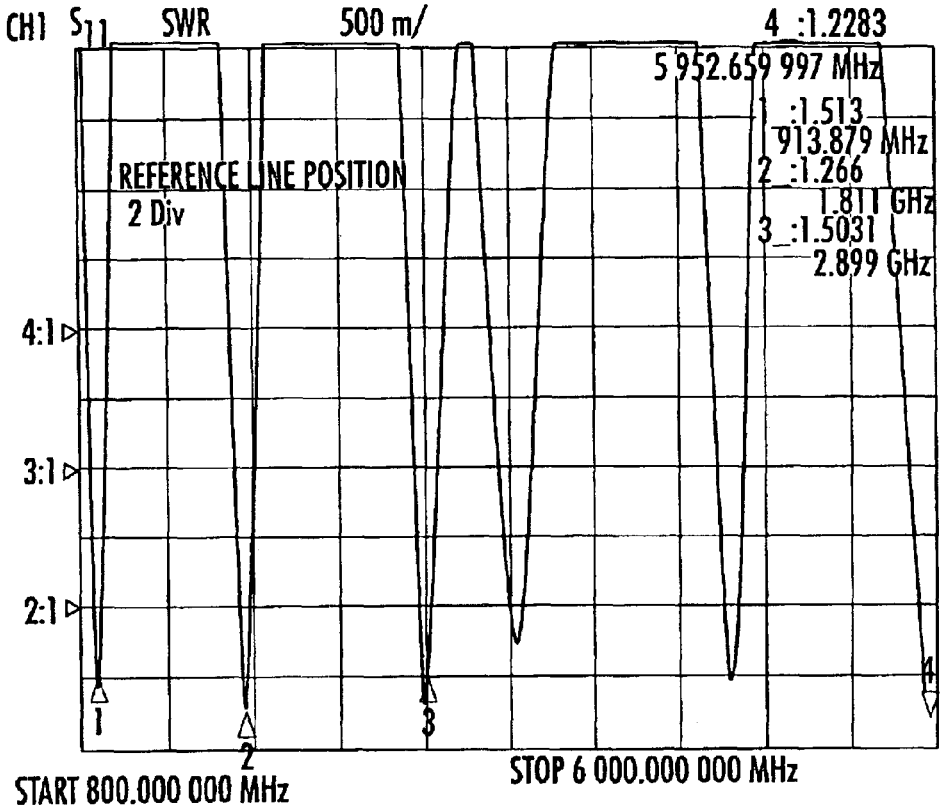
FIG. 7 is a VSWR plot of a basic looped design antenna according to embodiments of the present invention.

FIG. 7 illustrates an exemplary VSWR of an antenna 20 having a basic looped track 22 according to embodiments of the present invention with the antenna having about a 3 mm antenna height from ground. As shown, there is a ¼ wave resonance at low band (913 MHz) and a plurality of high band resonances including ½ wave resonance at 1.8 GHz. Other high band resonances include 2.9 GHz, 3.45 GHz, 4.75 GHz and 5.95 GHz. Additional higher order modes may be present but were not measured with the equipment used.

Figure 8A:
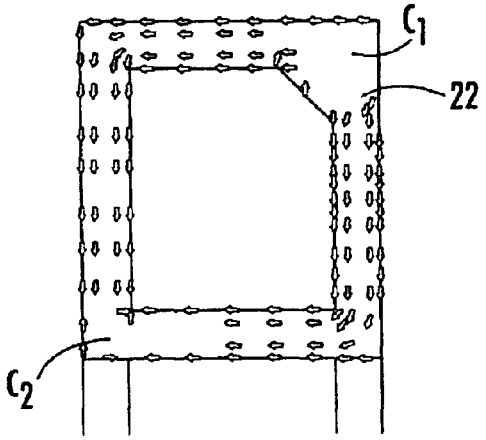
FIGS. 8A and 8B are top views of a looped antenna configuration with current vectors illustrating that high band currents can oscillate between opposing corners according to embodiments of the present invention.
Figure 8B:
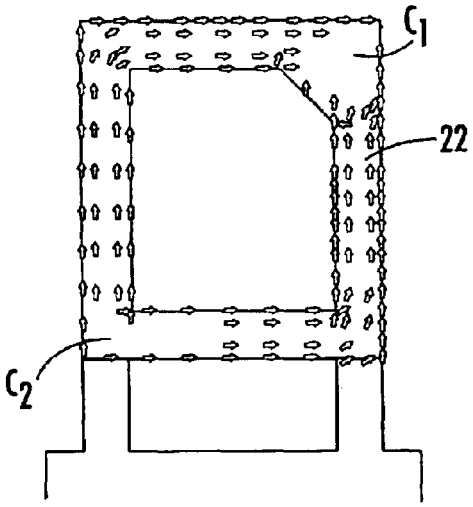

FIGS. 8A and 8B illustrate that high-band currents can oscillate between opposing sides (shown for example, as corners $C_1$, $C_2$) of the looped track 22. The current on the left and right (and top and bottom) is substantially parallel and traveling in the same direction (i.e., they are not canceling each other).

Figure 9B:
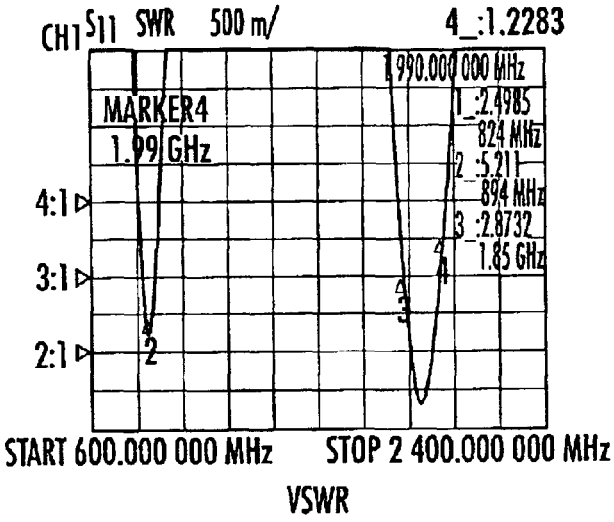
FIG. 9B is a VSWR plot of the antenna shown in FIG. 9A.
Figure 9A:
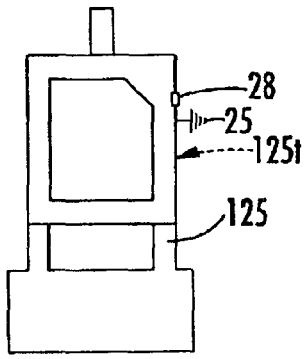
FIG. 9A is top view of a looped antenna with a modified ground plane design that substantially corresponds to the looped antenna configuration according to embodiments of the present invention.

FIG. 9A again illustrates the antenna 20 with looped track 22 positioned about 3 mm (Z distance) from a ground plane 125 that also has a looped track 125*t* configuration (shown positioned under the antenna track 22). Removing the ground below the antenna aperture 22*a* and replacing it with a similarly shaped ground element 125, acceptable bandwidth and gain can be achieved at about a 3 mm height. The front to back ratio may still be about 4 db at high band, though low-band may become omni-directional. In this embodiment, the gain may be substantially vertical at both high and low bands. FIG. 9B illustrates an exemplary VSWR of the antenna 20 and ground plane 125 shown in FIG. 9A.

FIGS. 10A and 10C illustrate simulated average currents for the antenna 20 shown in FIG. 4A at 1850 MHz (FIG. 10A) and 1990 MHz (FIG. 10C) over a printed circuit board 161. FIG. 10B illustrates a simulated radiation pattern for the 1850 MHz current shown in FIG. 10A. FIG. 10D illustrates a simulated radiation pattern for the 1990 MHz current shown in FIG. 10C. The pattern at 1990 MHz is more omni-directional than that at 1850 MHz.

FIGS. 11A and 11C illustrate simulated average currents for the antenna 20 shown in FIG. 2A at 1850 MHz (FIG. 11A) and 1990 MHz (FIG. 11C). FIG. 11B illustrates a simulated radiation pattern for the 1850 MHz current shown in FIG. 11A. FIG. 11D illustrates a simulated radiation pattern for the 1990 MHz current shown in FIG. 11C. The top center of the printed circuit board 161 at 1990 MHz illustrates increased activity under the center branch. Thus, in this embodiment, the center branch 30 is the primary radiator.

The simulations were carried out using the commercial available software package IE3D available from Zeland Software, Inc., located in Fremont, Calif.

It is noted that although the looped track element 22 is shown in the figures as being substantially rectangular, other looped track configurations may be used. For example, ovals, parallelograms, or even appropriately configured curvilinear tracks with sufficient separation between opposing sides. In certain embodiments, the minimum distance around the inner loop should be sufficient to define two ½ wavelength paths for the high band operation. In certain embodiments, the outer distance around the loop (or distance from the feed/ground to the opposite side) should be sufficient to define two ¼ wavelength paths for the primary resonance.

Further, as is known to those of skill in the art, matching components may be added to improve the impedance match to a 50 Ohm source and/or to increase bandwidth and low-band gain. For example, adding about 1–3 nH of inductance in series with the feed may improve low-band without significantly influencing high-band. The ground plane may be modified by adding slots, apertures, and the like to make the antenna appear further from the ground plane to improve performance. A high-dielectric material may be added between the conductive element 21 and the ground plane 125 to allow for additional shrinking of the geometry of the antenna 20. Reducing the aperture 22*a* size may reduce gain. Resonating slots can be added to the ground plane 125 to significantly increase bandwidth at low-band and/or high band. Gain may be "shifted" from high band to low band as desired by bringing the ground pin closer to the signal feed.

An inverted-F antenna according to some embodiments of the invention can be assembled into a device with a wireless terminal such as a radiotelephone terminal with an internal ground plane and transceiver components operable to transmit and receive radiotelephone communication signals. The ground plane may be about 40 mm wide and about 125 mm in length.

The antenna 20 can be disposed substantially parallel to the ground plane 125 and is connected to the ground plane and the transceiver components via respective ground and signal feeds. The antenna 20 may be formed or shaped with a certain size and a position with respect to the ground plane so as to conform to the shape of the radiotelephone terminal housing or a subassembly therein. For example, the antenna may be placed on a substrate that defines a portion of an enclosed acoustic chamber. Thus, the antenna may not be strictly "planar" although in the vernacular of the art, it might still be referred to as a planar inverted-F antenna.

In addition, it will be understood that although the term "ground plane" is used throughout the application, the term "ground plane", as used herein, is not limited to the form of a plane. For example, the "ground plane" may be a strip or any shape or reasonable size and may include non-planar structures such as shield cans or other metallic objects.

The antenna conductive element may be provided with or without an underlying substrate dielectric backing, such as, for example, FR4 or polyimide. In addition, the antenna may include air gaps in the spaces between the branches or segments. Alternatively, the spaces may be at least partially filled with a dielectric substrate material or the conductive pattern formed over a backing sheet. Furthermore, an inverted-F conductive element, according to embodiments of the present invention, may have been disposed on and/or within a dielectric substrate.

The antenna conductive element 21 may be formed of copper and/or other suitable conductive material. For example, the conductive element branches may be formed from copper sheet. Alternatively, the conductive element branches may be formed from copper layered on a dielectric substrate. However, conductive element branches for inverted-F conductive elements according to the present invention may be formed from various conductive materials and are not limited to copper as is well known to those of skill in the art. The antenna can be fashioned in any suitable manner, including, but not limited to, metal stamping, forming the conductive material in a desired pattern on a flex film or other substrate whether by depositing, inking, painting, etching or otherwise providing conductive material traces onto the substrate material.

It will be understood that, although antennas according to embodiments of the present invention are described herein with respect to wireless terminals, embodiments of the present invention are not limited to such a configuration. For example, antennas according to embodiments of the present invention may be used within wireless terminals that may only transmit or only receive wireless communications signals. For example, conventional AM/FM radios or any receiver utilizing an antenna may only receive communications signals. Alternatively, remote data input devices may only transmit communications signals.

Figure 12:
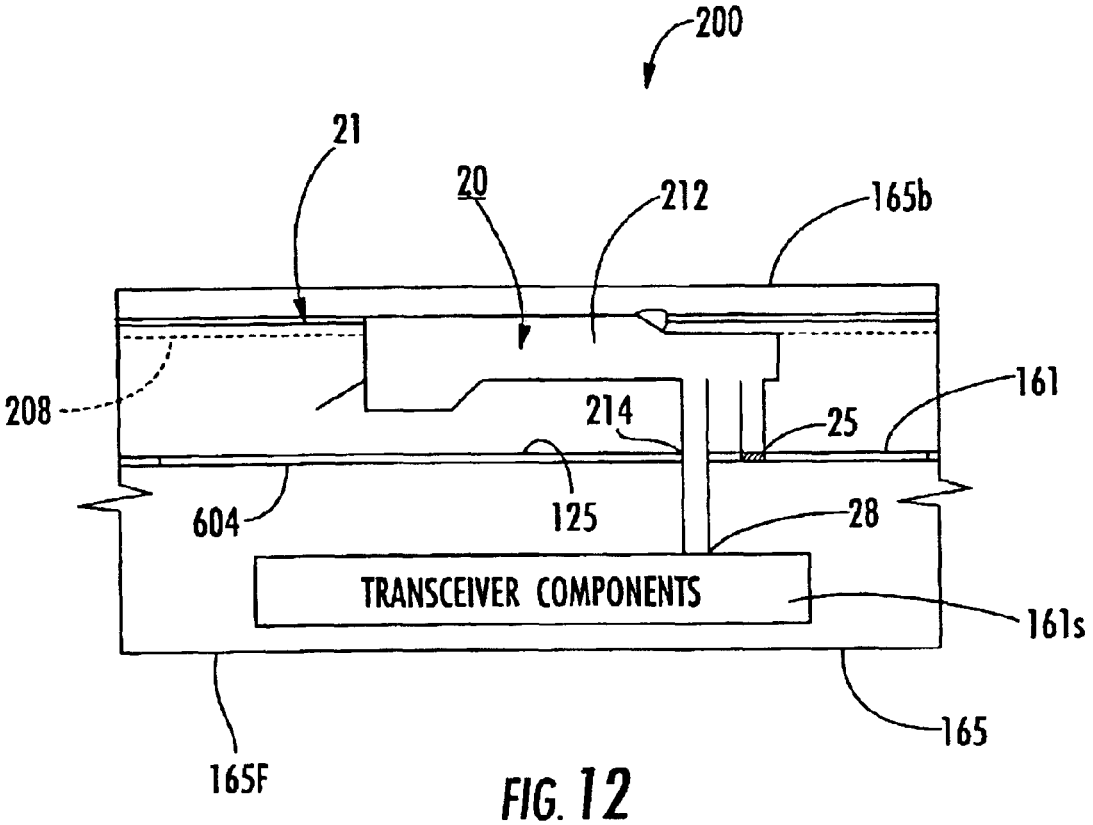
FIG. 12 is a partial side view of a wireless communication device according to embodiments of the present invention.

Referring now to FIG. 12, a wireless terminal 200 is illustrated. As shown, the antenna 20 includes a conductive element 21 that is maintained in spaced apart relationship with a ground plane 125 that is typically held on a printed circuit board 161. The antenna element 21 is in communication with a signal feed 28 and a ground feed 25. The signal and ground feeds 28, 25 can be positioned adjacent each other and disposed on a common edge portion of the element 21. In certain embodiments, the signal and ground feeds 28, 25 are positioned proximate a common outer edge portion. The term "common outer edge portion" means the signal and ground feeds are positioned adjacent each other near or on an outside or end portion of the looped track 22 of the conductive element 21 (with no conductive element spacing them apart). This configuration is in contrast to where the ground is positioned on a first portion of the element and the signal across from the ground with an expanse of conductive element that separates the signal and feed (such as for center fed configurations).

Referring again to FIG. 12, a conventional arrangement of electronic components that allow a wireless terminal 200 to transmit and receive wireless terminal communication signals will be described in further detail. As illustrated, an antenna 20 for receiving and/or transmitting wireless terminal communication signals is electrically connected to transceiver circuitry components 161*s*. The components 161*s* can include a radio-frequency (RF) transceiver that is electrically connected to a controller such as a microprocessor. The controller can be electrically connected to a speaker that is configured to transmit a signal from the controller to a user of a wireless terminal. The controller can also electrically connected to a microphone that receives a voice signal from a user and transmits the voice signal through the controller and transceiver to a remote device. The controller can be electrically connected to a keypad and display that facilitate wireless terminal operation. The design of the transceiver, controller, and microphone are well known to those of skill in the art and need not be described further herein.

The wireless communication device 200 shown in FIG. 12 may be a radiotelephone type radio terminal of the cellular or PCS type, which makes use of an antenna 20 according to embodiments of the present invention. As shown, the device 200 includes a signal feed 28 that extends from a signal receiver and/or transmitter (e.g., an RF transceiver) comprising electronic transceiver components 161*s*. The ground plane 125 serves as the ground plane for the planar inverted-F antenna 20. The antenna 20 may include a dielectric substrate backing shown schematically by dotted line 208. The antenna 20 can include wrapped portions 212, which serve to connect the conductive element 21 to the signal and ground feeds 28, 25. The ground feed 25 is connected to the ground plane 125. The antenna 20 can be installed substantially parallel to the ground plane 125, subject to form shapes, distortions and curvatures as might be present for the particular application, as previously discussed. The signal feed 28 can pass through an aperture 214 in the ground plane 125 and is connected to the transceiver components 161*s*. The transceiver components 161*s*, the ground plane 125, and the inverted-F antenna 20 can be enclosed in a housing 165 for the wireless (i.e., radiotelephone) terminal. The housing 165 can include a back portion 165*b* and front portion 165*f*. The wireless device 200 may include other components such as a keypad and display as noted above. The ground plane 125 may be configured to underlie or overlie the antenna 20.

It is noted that the branch pattern configurations of the antennas 20 shown herein may be re-oriented, such as rotated such as 10–90, typically 90, 180 or 270 degrees. In addition or alternatively, the configurations may be re-oriented in a mirrored pattern (such as left to right). The antennas 20 may be configured to occupy an area that is less than about 1200 $mm^2$. Typically, the antenna has a perimeter that is less than about 40 mm height×40 mm width×11 mm depth. In certain embodiments, the antenna 20 can be configured to be equal to or less than about 31 mm height and/or width with a depth that is less than about 11 mm (typically 4–7 mm).

Figure 13A:
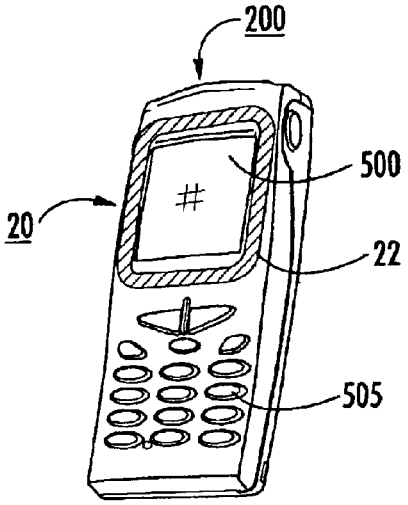
FIGS. 13A–13C are schematic front views of wireless communication devices having a looped antenna configuration positioned about the perimeter of a display according to embodiments of the present invention.
Figure 13B:
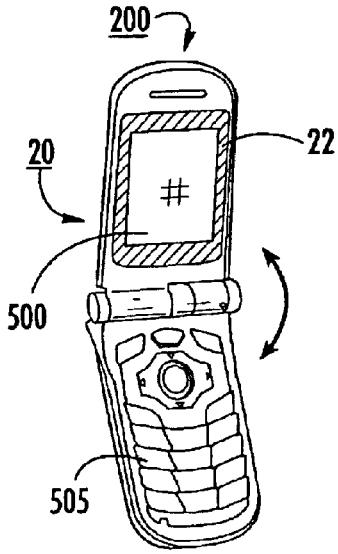
Figure 13C:
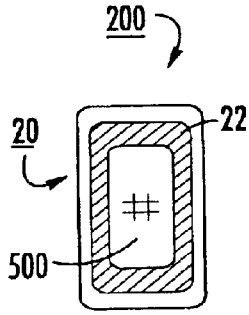

FIGS. 13A–13C are schematic front views of wireless communication devices 200 having an antenna 20 with a looped conductive element positioned about the perimeter of a display 500 according to embodiments of the present invention. The display 500 can be any suitable graphic or image display such as an LCD. The looped conductive element 22 may be sized and configured to be offset a distance from the display perimeter or to be closely spaced relative thereto. The device 200 may include a keypad (alphanumeric key entry) on the same surface as shown in FIG. 13A, on a different member (in a flip or clam-shell configuration as shown in FIG. 13B), or on a rear surface (FIG. 13C). The flip configuration may be particularly suitable to form a wireless communication device such as a cellular telephone, which employs two attached housing members that flip or pivot from a closed stored position to an open position.

Figure 14A:
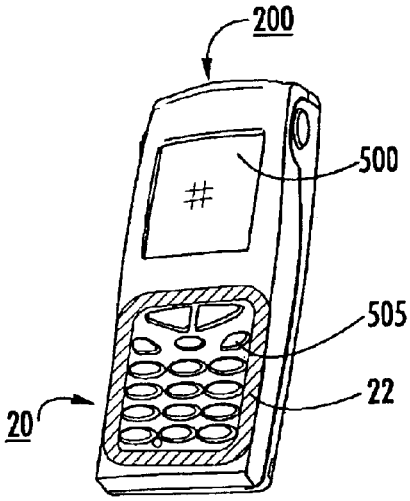
FIGS. 14A–14C are schematic front views of wireless communication devices having a looped antenna configuration positioned about the perimeter of a keypad or keyboard according to embodiments of the present invention.
Figure 14B:
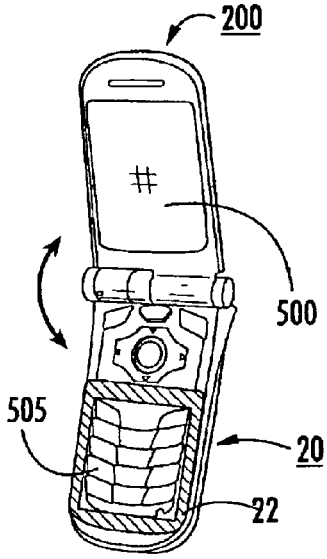
Figure 14C:
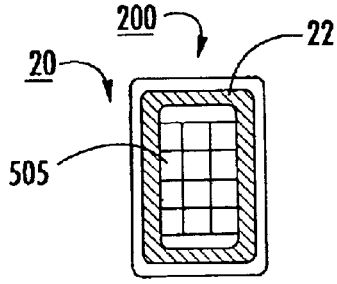

FIGS. 14A–14C are schematic front views of wireless communication devices 200 having an antenna 20 with a looped conductive element 22 positioned about the perimeter of a keypad or keyboard 505 according to embodiments of the present invention. The keypad 505 may be disposed in different configurations on the device similar to the configurations discussed for the displays 500 above. The device 200 may include looped elements in more than one location, such as combinations of the positions shown in FIGS. 13A–13C and 14A–14C. The looped element 22 may also be positioned on the rear surface below the display or keypad (not shown).

In the drawings and specification, there have been disclosed embodiments of the invention and, although specific terms are employed, they are used in a generic and descriptive sense only and not for purposes of limitation, the scope of the invention being set forth in the following claims.

Thus, the foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses, where used, are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A planar inverted-F antenna having a plurality of resonant frequency bandwidths of operation, comprising:

a signal feed;

a ground feed; and a conductive element in communication with the signal and ground feed, the conductive element comprising a looped track that, in operation, provides a high band resonator and a low band resonator, wherein the ground and signal feeds are positioned adjacent each other proximate a common outer edge portion of the looped track, and wherein the looped track provides about ¼ wave resonance at low band; and wherein at high band the looped track forms two ½ wave resonances, one on each of two opposing sides of the looped track.

2. A planar inverted-F antenna having a plurality of resonant frequency bandwidths of operation, comprising:

a signal feed;

a ground feed; and a conductive element in communication with the signal and ground feed, the conductive element comprising a looped track that in operation, provides a high band resonator and a low band resonator; and wherein the looped track is continuous and comprises four sides with four corner portions that define a track perimeter with an enclosed center portion, with adjacent sides being contiguous about corner portions thereof, wherein corresponding pairs of the four sides face each other across the center portion, and wherein one corresponding pair has a longer length than the other pair.

3. An antenna according to claim 2, wherein, during operation at high band, the looped track is configured and positioned with respect to the signal and ground feeds to define current null spaces at two portions that are opposed from each other.

4. An antenna according to claim 3, wherein the four sides include a left and right side which define a first corresponding pair and a top and bottom side which define a second corresponding pair, and wherein the signal and ground feed are disposed on the right side of the looped track.

5. An antenna according to claim 2, wherein, during operation at low band, the looped track is configured and positioned with respect to the signal and ground feeds to define one current null space in one corner portion with the current traveling along the looped track away from the signal and feed toward the null space corner from at least three of the four sides, with the current traveling in a substantially common direction along corresponding pairs of the four sides.

6. An antenna according to claim 2, wherein at high band, current travels in a direction that oscillates between two null space portions with current traveling in substantially the same direction in two opposing sides.

7. An antenna according to claim 6, wherein the looped track has a substantially rectangular shape.

8. A planar inverted-F antenna having a plurality of resonant frequency bandwidths of operation, comprising:

a signal feed;

a ground feed; and a conductive element in communication with the signal and ground feed, the conductive element comprising a looped track that, in operation, provides a high band resonator and a low band resonator; and wherein the looped track baa an outer and inner perimeter that encases an inner center portion, and wherein the conductive element further comprises a secondary branch that extends away from the looped track and is in conductive communication with the signal and feed and resonates at high band.

9. An antenna according to claim 8, wherein the secondary branch extends inwardly into the center portion of the looped track.

10. An antenna according to claim 9, wherein the secondary branch extends outwardly away from the center portion of the looped track.

11. An antenna according to claim 8, wherein the secondary branch is attached to and angularly extends away from a first side of the looped track and resonates at high band at about 1990 MHz, and wherein the looped track resonates at high band at about 1850 MHz.

12. A planar invented-F antenna having a plurality of resonant frequency bandwidths of operation, comprising:

a signal feed;

a ground feed; and a conductive element in communication with the signal and ground feed, the conductive element comprising a looped track that, in operation, provides a high band resonator and a low band resonator; and wherein the looped track comprises four sides with a perimeter, said antenna further comprising a secondary branch with opposing end portions, one end portion being attached to a selected side of the looped track with the secondary branch having a strip that is spaced apart from and extends substantially parallel to and along a major portion of the length the selected side of the perimeter and is in conductive communication with the signal and feed.

13. An antenna according to claim 12, wherein the secondary branch radiates at about 1575 MHz.

14. An antenna according to claim 13, wherein the looped track resonates at about 2.1 GHz at high band and about 824–894 MHz at low band.

15. A planar inverted-F antenna having a plurality of resonant frequency bandwidths of operation, comprising:

a signal feed;

a ground feed; and a conductive element in communication with the signal and ground feed, the conductive element comprising a looped track that, in operation, provides a high band resonator and a low band resonator, wherein the looped track comprises four sides with a perimeter, said antenna further comprising:

a secondary branch that is spaced apart from and extends substantially parallel to and along a portion of the length of one side of the perimeter; and a second ground feed in conductive communication with the secondary branch, wherein said secondary branch is parasitically coupled to the looped track during operation.

16. An antenna according to claim 15, wherein the second ground feed is disposed adjacent a top outer edge portion of the secondary branch, and wherein the secondary branch is the primary resonator at a portion of the high band between about 1930–1990 MHz, wherein the antenna radiates at low band at between about 824–894 MHz and at high band between about 1.85–1.99 GHz.

17. A planar inverted-F antenna having a plurality of resonant frequency bandwidths of operation, comprising:

a signal feed;

a ground feed; and a conductive element in communication with the signal and ground feed, the conductive element comprising a looped track that, in operation, provide a high band resonator and a low band resonator; and wherein the conductive element is configured with first, second and third branches that are in communication with the signal and ground feed to provide a quad band antenna.

18. An antenna according to claim 17, wherein the looped track comprises four sides with a perimeter, wherein said antenna first branch has opposing end portions, one end portion being attached to a selected side of the looped track with the second branch having a strip that is spaced apart from and extends substantially parallel to and along a major portion of the length of the selected one side of the perimeter and is in conductive communication with the signal and feed.

19. An antenna according to claim 18, wherein said antenna second branch extending substantially orthogonally off one side of the looped track, the one side being adjacent the signal and feed.

20. An antenna according to claim 19, wherein said antenna third branch is disposed above the uppermost side of the looped track and extends substantially parallel thereto.

21. An antenna according to claim 20, wherein said quad antenna resonates at low band at between about 824–894 MHz and at high band at about 1575 MHz, 1850–1990 MHz, and about 2400–2485 MHz.

22. A planar inverted-F antenna having a plurality of resonant frequency bandwidths of operation, comprising:

a signal feed;

a ground feed; and a conductive element in communication with the signal and ground feed, the conductive element comprising a looped track that, in operation, provides a high band resonator and a low band resonator; and wherein the looped track is substantially rectangular, and wherein at least one internal corner portion includes an angularly oriented corner tuning member that connects adjacent sides of the track.

23. A planar inverted-F antenna having a plurality of resonant frequency bandwidths of operation, comprising:

a signal feed;

a ground feed;

a conductive element in communication with the signal and ground feed, the conductive element comprising a looped track that, in operation, provides a high band resonator and a low band resonator; and a ground plane in communication with the ground feed and the conductive element wherein the ground plane is configured as a looped ground plane.

24. An antenna according to claim 23, wherein the looped ground plane configuration has a shape and size that substantially corresponds to the looped track antenna configuration.

25. A wireless terminal, comprising:

(a) a housing configured to enclose a transceiver that transmits and receives wireless communications signals;

(b) a ground plane disposed within the housing;

(c) a planar inverted-F antenna disposed within the housing and electrically connected with the transceiver, wherein the antenna comprises:

a planar dielectric substrate;

a planar conductive element disposed on the planar dielectric substrate, comprising:

a looped track conductive element having a length and width and an center portion encased by the looped track, the looped track being configured to define about a ¼ wave resonator at a low frequency band and to define two about ½ wave resonators at a high frequency band;

(d) a signal feed electrically connected to looped track element; and (e) a ground feed electrically connected to the looped track element proximate the signal feed.

26. A wireless terminal according to claim 25, wherein the looped track element comprises an endless perimeter with four sides, wherein the ground and signal feeds are positioned within about 3–6 mm of each other proximate a common side at an upper or lower edge portion of the common side of the looped track element.

27. A wireless terminal according to claim 26, wherein the ground and signal feeds are positioned adjacent each other proximate a common outer side edge portion of the side of the looped track element with the ground positioned below the signal feed when viewed from the top.

28. A wireless terminal according to claim 25, wherein the looped track element is continuous and comprises four sides with four corner portions that define a track perimeter with the enclosed center portion, with adjacent sides being contiguous about corner portions thereof, wherein corresponding pairs of the four sides face each other across the center portion, and wherein one corresponding pair has a longer length than the other pair.

29. A wireless terminal according to claim 28, wherein, during operation at high band, the looped tack element is configured and positioned with respect to the signal and ground feeds to define two current null spaces, one on each of two sides of the looped track element so that the null spaces are substantially opposite from each other separated by the center portion.

30. A wireless terminal according to claim 29, wherein at high band, current travels in a direction that oscillates between the two null portions with current traveling in the same direction in the corresponding pairs of the sides.

31. A wireless terminal according to claim 28, wherein, during operation at low band, the looped track element is configured and positioned with respect to the signal and ground feeds to define one current null space in one corner portion with the current traveling along the looped track away from the signal and feed toward the null space corner from at least three of the four sides and with current traveling in a substantially common direction along corresponding pairs of the four sides.

32. A wireless terminal according to claim 28, wherein the four sides include a left and right side which define a first corresponding pair and a top and bottom side which define a second corresponding pair, and wherein the signal and ground feed are disposed on the right side of the looped track element.

33. A wireless terminal according to claim 28, wherein the center portion is an air space that is sized and configured to receive a display member therein, said wireless terminal further comprising a display having a perimeter positioned in the center portion of the looped track element such that the looped track element perimeter follows the perimeter of the display.

34. A wireless terminal according to claim 33, wherein the wireless terminal comprises a flip housing member that holds the display and looped track element and can pivot from a closed stored position to an open position.

35. A wireless terminal according to claim 28, wherein the center portion is an air space that is sized and configured to receive a keypad therein, said wireless terminal further comprising a keypad having a perimeter positioned in the center portion of the looped track element such that the looped track perimeter follows the perimeter of the keypad.

36. A wireless terminal according to claim 25, wherein the looped track element has a substantially rectangular shape.

37. A wireless terminal according to claim 25, wherein the looped track element has an outer and inner perimeter that encases the center portion, and wherein the conductive element further comprises a secondary branch that extends away from the looped track element and is in conductive communication with the signal and feed and resonates at high band.

38. A wireless terminal according to claim 37, wherein the secondary branch extends inwardly into the center portion of the looped track element.

39. A wireless terminal according to claim 38, wherein the secondary branch extends outwardly away from the center portion of the looped track element.

40. A wireless terminal according to claim 37, wherein the secondary branch is attached to and angularly extends away from a first side of the looped track element and resonates at high band at a center frequency of about 1960 MHz, and wherein the looped track element resonates at high band at a center frequency of about 1880 MHz.

41. A wireless terminal according to claim 25, wherein the looped track element comprises four sides with a perimeter, said antenna further comprising a secondary branch with opposing end portions, one end portion being attached to a selected side of the looped track element with the secondary branch having a strip that is spaced apart from and extends substantially parallel to and along a major portion of the length the selected side of the perimeter and is in conductive communication with the signal and feed.

42. A wireless terminal according to claim 41, wherein the secondary branch radiates at about 1575 MHz.

43. A wireless terminal according to claim 42, wherein the looped branch element resonates at about 2.1 GHz at high band and about 824–894 MHz at low band.

44. A wireless terminal according to claim 25, wherein the looped track element comprises four sides with a perimeter, said antenna further comprising:

a secondary branch that is spaced apart from and extends substantially parallel to and along a portion of the length of one side of the perimeter; and a second ground feed in conductive communication with the secondary branch, wherein said secondary branch is parasitically coupled to the looped track during operation.

45. A wireless terminal according to claim 44, wherein the second ground feed is disposed adjacent a top outer edge portion of the secondary branch, and wherein the secondary branch is the primary resonator at a portion of the high band between about 1930–1990 MHz, wherein the antenna radiates at low band at between about 824–894 MHz and at high band between about 1.85–1.99 GHz.

46. A wireless terminal according to claim 25, wherein the conductive looped track element is configured with first, second and third branches that are in communication with the signal and ground feed to provide a quad band antenna.

47. A wireless terminal according to claim 46, wherein the looped track element comprises four sides with a perimeter, wherein said antenna first branch having opposing end portions, one end portion being attached to a selected side of the looped track element with the secondary branch having a strip that is spaced apart from and extends substantially parallel to and along a major portion of the length of the selected one side of the perimeter and is in conductive communication with the signal and feed.

48. A wireless terminal according to claim 47, wherein said antenna second branch extends substantially orthogonally off one side of the looped track element, the one side being adjacent the signal and feed.

49. A wireless terminal according to claim 48, wherein said antenna third branch is disposed above the uppermost side of the looped track element and extends substantially parallel thereto.

50. A wireless terminal according to claim 49, wherein said quad antenna resonates at low band at between about 824–894 MHz and at high band at about 1575 MHz, 1850–1990 MHz, and about 2400–2485 MHz.

51. A wireless terminal according to claim 25, wherein the looped track element is substantially rectangular, and wherein at least one internal corner portion includes an angularly oriented corner tuning member that connects adjacent sides of the track.

52. A wireless terminal according to claim 25, wherein the ground plane is configured as a looped ground plane.

53. A wireless terminal according to claim 52, wherein the looped ground plane configuration has a shape and size that substantially corresponds to the looped track element antenna configuration.

54. A wireless terminal according to claim 25, wherein the antenna is positioned at about a 6 mm distance or less from the ground plane.

55. A wireless terminal according to claim 25, wherein the antenna is positioned at about a 3–6 mm distance from the ground plane.

56. A wireless terminal according to claim 25, wherein the center portion is an air gap adapted to receive a display therein.

57. A wireless terminal according to claim 25, wherein the looped track extends around the outer perimeter of a liquid crystal display.

58. A method for exciting a planar inverted F antenna having low and high band operational modes:

providing a conductive element with a looped track element, the looped track element configured to form about a ¼ wave resonator at a low frequency band and about a ½ wave resonator at a high frequency band;

generating a current null along at least one portion of the looped track element at a selected low band operation; and generating a current null and a current maxima at two spaced apart portions of the looped track element at a selected high band operation with one of the current maximas located proximate a signal feed and the other current maxima located generally opposite the signal feed.

59. A method according to claim 58, further comprising positioning the looped track element at about 3–6 mm from a ground plane.

60. A method according to claim 59, further comprising configuring the ground plane as a looped ground plane.

61. A method according to claim 58, wherein the step of generating a current null at two spaced apart portions of the looped track element at a selected high band operation comprises generating two current nulls at opposing sides of the looped track.

62. A method according to claim 61, further comprising generating two substantially parallel ½ wave resonators at high band, one along each of the two sides of the looped track element that is devoid of a current nulls.

63. A method according to claim 62, wherein one current null is located at a center portion of an upper side of the looped track element and the other current null is located at a center portion of a lower side of the looped track element.

64. A method according to claim 63, wherein the parallel resonators are the left and right sides of the looped track element.

65. A method according to claim 64, further comprising positioning a signal feed and ground feed proximate an upper outer edge portion of the right side of the looped track with the ground feed located about 3–6 mm below the signal feed along the right side of the looped track element.

66. A wireless terminal, comprising:

(a) a housing configured to enclose a transceiver that transmits and receives wireless communications signals;

(b) a ground plane disposed within the housing;

(c) a planar inverted-F antenna disposed within the housing and electrically connected with the transceiver, wherein the antenna comprises:

a generally planar dielectric substrate;

a generally planar conductive element disposed on the dielectric substrate, comprising:

a looped track conductive element having a length and width and a center portion encased by the looped track, the looped track configured to define about a ¼ wave resonator at a first frequency band having a primary resonance and to define two about ½ wave resonators at a second frequency band at a second harmonic;

(d) a signal feed electrically connected to the looped track element; and (e) a ground feed electrically connected to the looped track element proximate the signal feed.

67. A wireless terminal according to claim 66, wherein the looped track element comprises an endless perimeter with four sides, wherein the ground and signal feeds are positioned within a distance range of about 3 mm to about 6 mm of each other proximate a common side at an upper or lower edge portion of the common side of the looped track element.

68. A wireless terminal according to claim 66, wherein the ground and signal feeds are positioned adjacent each other proximate a common outer side edge portion of one side of the looped track element with the ground positioned below the signal feed when viewed from the top.

69. A wireless terminal according to claim 66, wherein the first frequency band operates at frequencies with a center frequency that is less than 1000 MHz and the second frequency band operates at frequencies with a center that is less than about twice 1000 MHz.

70. A wireless terminal according to claim 66, wherein the looped track element is continuous and comprises four sides with four corner portions that define a track perimeter with the enclosed center portion, with adjacent sides being contiguous about corner portions thereof, wherein corresponding pairs of the four sides face each other across the center portion, and wherein one corresponding pair has a longer length than the other pair.

71. A wireless terminal according to claim 66, wherein the first frequency band is low band and the second frequency band is high band, and wherein during operation at high band, the looped track element is configured and positioned with respect to the signal and ground feeds to define first and second current null spaces, one on each of two sides of the looped track element so that the null spaces are substantially opposite from each other separated by the center portion.

72. A wireless terminal according to claim 71, wherein, during operation at low band, the looped track element is configured and positioned with respect to the signal and ground feeds to define one current null space in one corner portion with the current generally traveling along the looped track away from the signal and feed toward the null space corner from at least three of the four sides and with current generally traveling in a substantially common direction along corresponding pairs of the four sides.

73. A wireless terminal according to claim 71, wherein at high band, current travels in a direction that oscillates between the two null spaces with current generally traveling in the same direction on opposing sides of the looped element.

74. A wireless terminal according to claim 66, wherein the looped track element has an outer and inner perimeter that encases the center portion, and wherein the conductive element further comprises a secondary branch that extends away from the looped track element and is in conductive communication with the signal and feed and resonates at high band.

75. A wireless terminal according to claim 74, wherein the secondary branch extends inwardly into the center portion of the looped track element.

76. A wireless terminal according to claim 74, wherein the secondary branch extends outwardly away from the center portion of the looped track element.

77. A wireless terminal according to claim 74, wherein the secondary branch is attached to and angularly extends away from a first side of the looped track element and resonates at high band at a center frequency of about 1960 MHz, and wherein the looped track element resonates at high band at a center frequency of about 1880 MHz.

* * * * *

UNITED STATES PATENT AND TRADEMARK OFFICE

CERTIFICATE OF CORRECTION

PATENT NO. : 6,909,402 B2
DATED : June 21, 2005
INVENTOR(S) : Vance

It is certified that error appears in the above-identified patent and that said Letters Patent is hereby corrected as shown below:

Column 16,
Line 20, should read -- wherein the looped track has an outer and inner perimeter --.

Signed and Sealed this

Tenth Day of January, 2006

JON W. DUDAS
*Director of the United States Patent and Trademark Office*